US007784895B2

(12) United States Patent
Azami et al.

(10) Patent No.: US 7,784,895 B2
(45) Date of Patent: Aug. 31, 2010

(54) LIQUID DISCHARGING APPARATUS WITH A TRANSPORT MECHANISM WITH VARYING SPEED CAPABILITIES TO REDUCE POWER CONSUMPTION

(75) Inventors: Yoshiko Azami, Matsumoto (JP); Hirokazu Nunokawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 208 days.

(21) Appl. No.: 11/951,196

(22) Filed: Dec. 5, 2007

(65) Prior Publication Data

US 2008/0136856 A1 Jun. 12, 2008

(30) Foreign Application Priority Data

Dec. 6, 2006 (JP) ..... 2006-329711

(51) Int. Cl.
*B41J 29/38* (2006.01)

(52) U.S. Cl. ..... 347/16; 347/13

(58) Field of Classification Search ..... 347/16
See application file for complete search history.

(56) References Cited

U.S. PATENT DOCUMENTS 5,349,905 A * 9/1994 Taylor et al. ..... 347/16
6,536,967 B2 * 3/2003 Inoue ..... 347/42
6,568,776 B1 * 5/2003 Kato ..... 347/8
2005/0219293 A1 * 10/2005 Kachi ..... 347/14
2006/0023048 A1 * 2/2006 Mattern ..... 347/104
2006/0033764 A1 * 2/2006 Aoki ..... 347/9
2006/0209110 A1 * 9/2006 Vinas et al. ..... 347/13

FOREIGN PATENT DOCUMENTS

JP 05-155117 6/1993
JP 2001-038889 2/2001
JP 2002-240300 8/2002

* cited by examiner

*Primary Examiner*—Matthew Luu
*Assistant Examiner*—Shelby Fidler
(74) *Attorney, Agent, or Firm*—Workman Nydegger

(57) ABSTRACT

A liquid discharging apparatus includes upstream side nozzle group, a downstream side nozzle group, and a transport mechanism. The downstream side nozzle group is located on a downstream side in a transport direction as compared with the upstream side nozzle group. The transport mechanism transports a medium in the transport direction to the upstream side nozzle group and to the downstream side nozzle group. The upstream side nozzle group and the downstream side nozzle group each are formed of a plurality of nozzle columns that are arranged in the transport direction. Each of the nozzle columns is formed so that a plurality of nozzles that discharge liquid are arranged in a direction that intersects with the transport direction. A transport speed varies in accordance with the number of nozzle columns used.

14 Claims, 20 Drawing Sheets

LIQUID DISCHARGING APPARATUS WITH A TRANSPORT MECHANISM WITH VARYING SPEED CAPABILITIES TO REDUCE POWER CONSUMPTION

BACKGROUND

1. Technical Field

The invention relates to a liquid discharging apparatus.

2. Related Art

An ink jet printer is known as one of liquid discharging apparatuses. The ink jet printer performs printing on various types of medium, such as paper, cloth, or film, by discharging ink from nozzles. Almost all ink jet printers perform printing while moving a head (nozzles) in a direction that intersects with the transport direction of a medium (a carriage type printer).

In recent years, a line head printer, of which a nozzle column has a length of paper width, the nozzle column being arranged along a direction that intersects with the transport direction of a medium, has been developed. The line head printer performs printing by transporting a medium without moving a head, so that it is able to perform printing at high speed, which is, for example, described in Japanese Unexamined Patent Application Publication No. 2002-240300. However, in the line head printer, because ink is discharged from multiple numbers of nozzles at the same time, electric power consumed by the printer increases.

Then, there has occurred a trouble in which a power failure process is performed because of a decrease in voltage of a power supply portion and, as a result, printing is stopped. Then, a method has been proposed, in which a setting voltage for activating a power failure process is decreased when ink is discharged from multiple numbers of nozzles at the same time, which is, for example, described in Japanese Unexamined Patent Application Publication No. 5-155117.

Thus, in the line head printer, there is a possibility that ink is discharged from multiple numbers of nozzles at the same time. In this case, because electric power consumption increases, there has been a problem in which printing is not performed normally, or the like.

SUMMARY

An advantage of some aspects of the invention is that it reduces a maximum electric power consumed by a line head printer.

An aspect of the invention provides a liquid discharging apparatus. The liquid discharging apparatus includes upstream side nozzle group, a downstream side nozzle group, and a transport mechanism. The downstream side nozzle group is located on a downstream side in a transport direction as compared with the upstream side nozzle group. The transport mechanism transports a medium in the transport direction to the upstream side nozzle group and to the downstream side nozzle group. The upstream side nozzle group and the downstream side nozzle group each are formed of a plurality of nozzle columns that are arranged in the transport direction. Each of the nozzle columns is formed so that a plurality of nozzles that discharge liquid are arranged in a direction that intersects with the transport direction. A transport speed varies in accordance with the number of nozzle columns used.

Other aspects of the invention will be apparent from the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Overview of Disclosure

Figure 1:
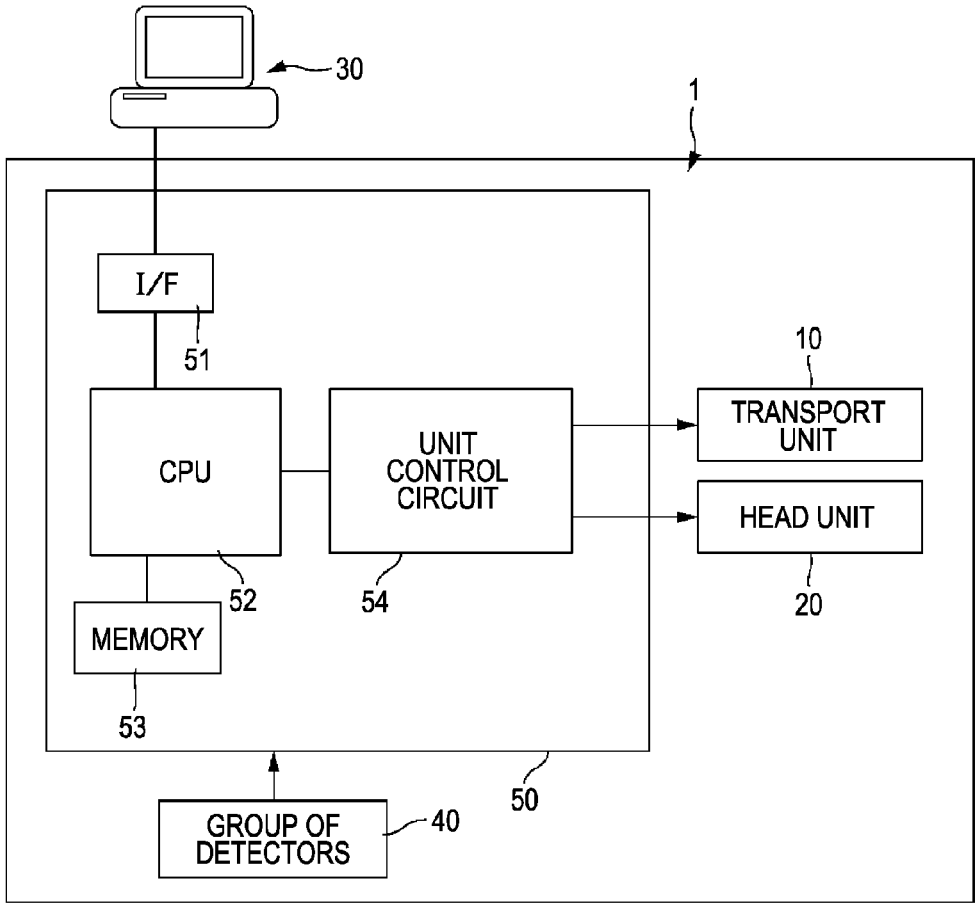
FIG. 1 is a block diagram of a general configuration of a printer according to an embodiment of the invention.

At least the following aspects will become apparent from the description in the specification and the accompanying drawings.

That is, it is possible to realize a liquid discharging apparatus that includes an upstream side nozzle group, a downstream side nozzle group located on a downstream side as compared with the upstream side nozzle group, and a transport mechanism that transports a medium to the upstream side nozzle group and to the downstream side nozzle group in the transport direction, wherein the upstream side nozzle group and the downstream side nozzle group each are formed of a plurality of nozzle columns that are arranged in the transport direction, each of the nozzle columns is formed so that a plurality of nozzles that discharge liquid are arranged in a direction that intersects with the transport direction, and a transport speed varies in accordance with the number of nozzle columns used. According to the above liquid discharging apparatus, a liquid discharging mode may be varied in accordance with the number of nozzle columns used, so that it is possible to reduce the maximum power consumption. For example, when the number of nozzle columns used is large, a transport speed is reduced to delay the timing to discharge liquid. As a result, the number of nozzle columns from which liquid is discharged at the same time is reduced, so that the maximum power consumption is reduced. On the contrary, when the number of nozzle columns used is small, a transport speed is increased, it does not matter even when liquid is discharged from all the nozzle columns used at the same time, so that liquid discharge time may be shortened.

In the above liquid discharging apparatus, the transport speed when the number of nozzle columns used is more than a predetermined number is lower than the transport speed when the number of nozzle columns used is equal to or smaller than the predetermined number. According to the above liquid discharging apparatus, a transport speed is reduced when the number of nozzle columns used is large and, thereby, the timing to discharge liquid is delayed, so that it is possible to reduce the maximum power consumption.

In the above liquid discharging apparatus, the predetermined number is the number of nozzle columns that the upstream side nozzle group or the downstream side nozzle group has. According to the above liquid discharging apparatus, it is possible to prevent the maximum power consumption from being larger than power consumption when liquid is discharged at the same time from all the nozzle columns that the upstream side nozzle group or the downstream side nozzle group has.

In the above liquid discharging apparatus, when the number of nozzle columns used is more than the predetermined number, liquid is alternately discharged from the nozzles of the upstream side nozzle group and from the nozzles of the downstream side nozzle group. According to the above liquid discharging apparatus, when the number of nozzle columns used is large, it is possible to reduce the maximum power consumption.

In the above liquid discharging apparatus, the nozzle columns used are nozzle columns that face the medium at the same time. According to the above liquid discharging apparatus, irrespective of the size of a medium, it is possible to suppress the maximum power consumption to a certain value. As the size of a medium increases, the number of nozzle columns that face the medium at the same time increases. Then, if liquid is discharged from all the nozzle columns that face the medium at the same time, the maximum power consumption becomes large. Therefore, when the number of nozzle columns that face the medium at the same time is large, a transport speed is reduced to delay the timing to discharge liquid.

In the above liquid discharging apparatus, the transport speed is determined in accordance with the length of the medium in the transport direction. According to the above liquid discharging apparatus, irrespective of the size of a medium, it is possible to suppress the maximum power consumption to a certain value. When the length of a medium in the transport direction is large, because the medium faces the nozzle columns of both the upstream side nozzle group and the downstream side nozzle group at the same time, a transport speed is reduced to delay the timing to discharge liquid.

In the above liquid discharging apparatus, the nozzle columns used are nozzle columns that face, at the same time, an area on the medium, to which liquid is discharged. According to the above liquid discharging apparatus, even when the size of a medium is large, however, when an area to which liquid is discharged is small, liquid is discharged at the same time from nozzle columns used. Thus, it is possible to shorten liquid discharging time as much as possible.

In the above liquid discharging apparatus, the transport speed is determined on the basis of the length of the area in the transport direction. According to the above liquid discharging apparatus, even when the size of a medium is large, it is possible to shorten liquid discharging time as much as possible.

In the above liquid discharging apparatus, the transport speed when liquid is discharged using both the upstream side nozzle group and the downstream side nozzle group is lower than the transport speed when liquid is discharged using one of the upstream side nozzle group and the downstream side nozzle group. According to the above liquid discharging apparatus, on the basis of the nozzle columns used, it is possible to suppress the maximum power consumption to a certain value, and it is possible to shorten liquid discharging time as much as possible. For example, when one of the upstream side nozzle group and the downstream side nozzle group is used, the number of nozzle columns used is small. Thus, by increasing the transport speed, it is possible to discharge liquid at the same time from all the nozzle columns used.

In the above liquid discharging apparatus, when the nozzle columns of the downstream nozzle group are offset from nozzle columns of the upstream side nozzle group in the direction that intersects with the transport direction, the transport speed when liquid is discharged in a high resolution using both the upstream side nozzle group and the downstream side nozzle group is lower than the transport speed when liquid is discharged in a low resolution using one of the upstream side nozzle group and the downstream side nozzle group. According to the above liquid discharging apparatus, on the basis of nozzle columns used, it is possible to suppress the maximum power consumption to a certain value, and it is possible to shorten liquid discharging time when liquid is discharged in a low resolution.

In the above liquid discharging apparatus, when the upstream side nozzle group and the downstream side nozzle group each have nozzle columns that discharge first liquid and nozzle columns that discharge second liquid, the transport speed when the first liquid and the second liquid are discharged onto the medium is lower than the transport speed when the first liquid is discharged onto the medium but the second liquid is not discharged onto the medium. According to the above liquid discharging apparatus, even when the number of types of liquid discharged is small (for example, monochrome printing), and even when the number of types of liquid discharged is large (for example, color printing), it is possible to suppress the maximum power consumption to a certain value. In addition, when in monochrome printing, it is possible to shorten liquid discharging time.

In the above liquid discharging apparatus, the transport speed changes when the medium is being transported. According to the above liquid discharging apparatus, the transport speed changes on the basis of the number of used nozzle columns, which varies while a medium is being transported. Therefore, it is possible to shorten liquid discharging time as compared with transport is performed at a constant transport speed.

In the above liquid discharging apparatus, the transport speed is determined on the basis of the maximum number of nozzle columns used. According to the above liquid discharging apparatus, because the transport speed does not change while a medium is being transported, control becomes easy.

In the above liquid discharging apparatus, a mechanism that moves the upstream side nozzle group and the downstream side nozzle group relatively in the transport direction is provided. According to the above liquid discharging apparatus, the maximum power consumption is suppressed to a certain value on the basis of paper size to be printed, types of printable paper size increase.

Configuration of Line Head Printer and Printing Method

Figure 2A:
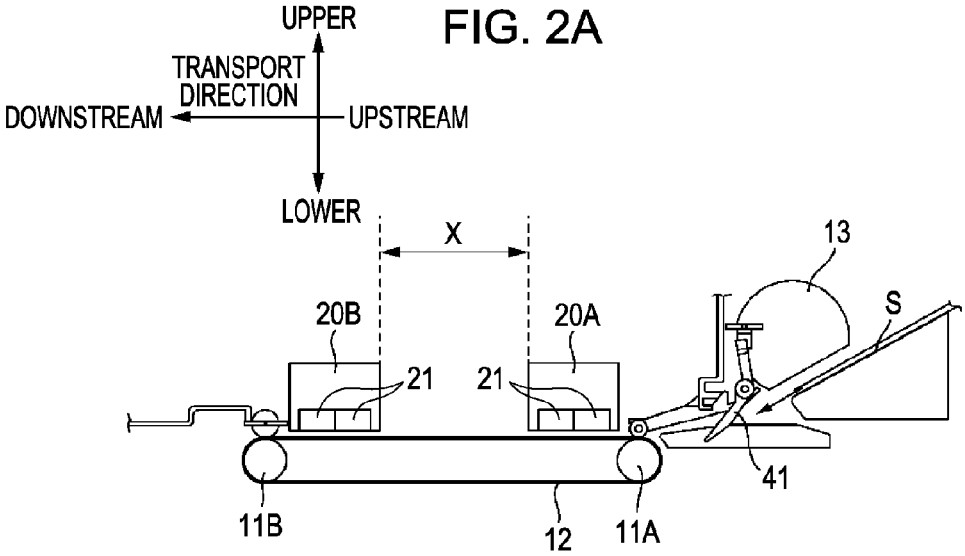
FIG. 2A is a longitudinal cross-sectional view of the printer.
Figure 2B:
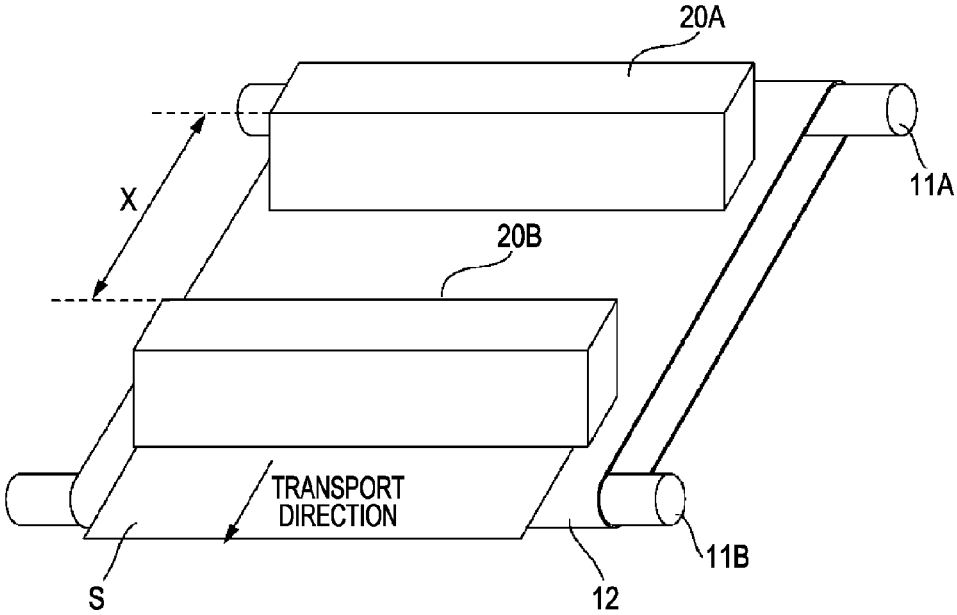
FIG. 2B is a view that shows a state where the printer transports a sheet of paper.

In an embodiment, a line head printer (hereinafter, printer 1) from among ink jet printers will be described, for example. FIG. 1 is a block diagram of a general configuration of the printer 1 according to the embodiment. FIG. 2A is a longitudinal cross-sectional view of the printer 1. FIG. 2B is a view that shows a state where the printer 1 transports a sheet of paper S (medium).

The printer 1 receives print data from a computer 30, which is an external device, and controls various units (a transport unit 10, a head unit 20) by a controller 50 and then forms an image on the sheet of paper S. In addition, a group of detectors 40 monitors status inside the printer 1 and, on the basis of the detected result, the controller 50 controls various units.

The controller 50 is a control unit for controlling the printer 1. An interface portion 51 is used to transmit and receive data between the computer 30, which is an external device, and the printer 1. A CPU 52 is a processing unit for executing control over the entire printer 1. A memory 53 is used to secure an area that stores a program of the CPU 52, a work area, and the like. The CPU 52 controls various units using a unit control circuit 54 in accordance with a program stored in the memory 53.

A transport unit 10 feeds a sheet of paper S to a printable position and transports the sheet of paper S by a predetermined amount of transport in the transport direction during printing. A paper feed roller 13 is a roller that is used for automatically feeding a sheet of paper S, which is inserted into a paper insertion portion, onto a transport belt 12 within the printer 1. Then, an annular transport belt 12 is rotated by both transport rollers 11A, 11B, and the sheet of paper S placed on the transport belt 12 is transported. Note that the sheet of paper S is electrostatically adsorbed or vacuum adsorbed to the transport belt 12 (not shown).

A head unit 20 is used for discharging ink onto a sheet of paper S. The head unit 20 includes a plurality of heads 21 and a head driving circuit 22. Each of the heads 21 has a plurality of nozzles, which are ink discharging portions. Each of the nozzles is provided with an ink chamber (not shown) that contains ink and a driving element (piezoelectric element PZT) that is used for discharging ink by varying the volume of the ink chamber. Moreover, the printer 1 of the embodiment includes two head units 20 (an upstream side head unit 20A and a downstream side head unit 20B). The upstream side head unit 20A is fixed at a position near the upstream side transport roller 11A. The downstream side head unit 20B is fixed at a position near the downstream side transport roller 11B. Then, the upstream side head unit 20A and the downstream side head unit 20B are arranged at a predetermined interval X in the transport direction.

The group of detectors 40 includes a rotary encoder, a paper detecting sensor 41, an optical sensor, and the like.

Printing Procedure

The controller 50, when receiving a print instruction and print data from the computer 30, analyzes the content of various commands included in the print data and performs the following processes using various units.

First, the controller 50 rotates the paper feed roller 13 to feed a sheet of paper S to be printed, onto the transport belt 12. Then, the controller 50 rotates the transport rollers 11A, 11B to position the fed sheet of paper S to a print start position. At this time, the sheet of paper S faces at least part of nozzles of the upstream side head unit 20A.

Next, the sheet of paper S is transported at a constant speed on the transport belt 12 and is passed below the upstream side head unit 20A and the downstream side head unit 20B. While the sheet of paper S is being passed below the head units 20, ink is intermittently discharged from the nozzles. As a result, a dot column (raster line) formed of a plurality of dots is formed on the sheet of paper S along the transport direction.

Finally, the controller 50 delivers the sheet of paper S, which has finished printing an image, from the transport roller 11B.

Lower Face of Head Unit 20

Figure 3:
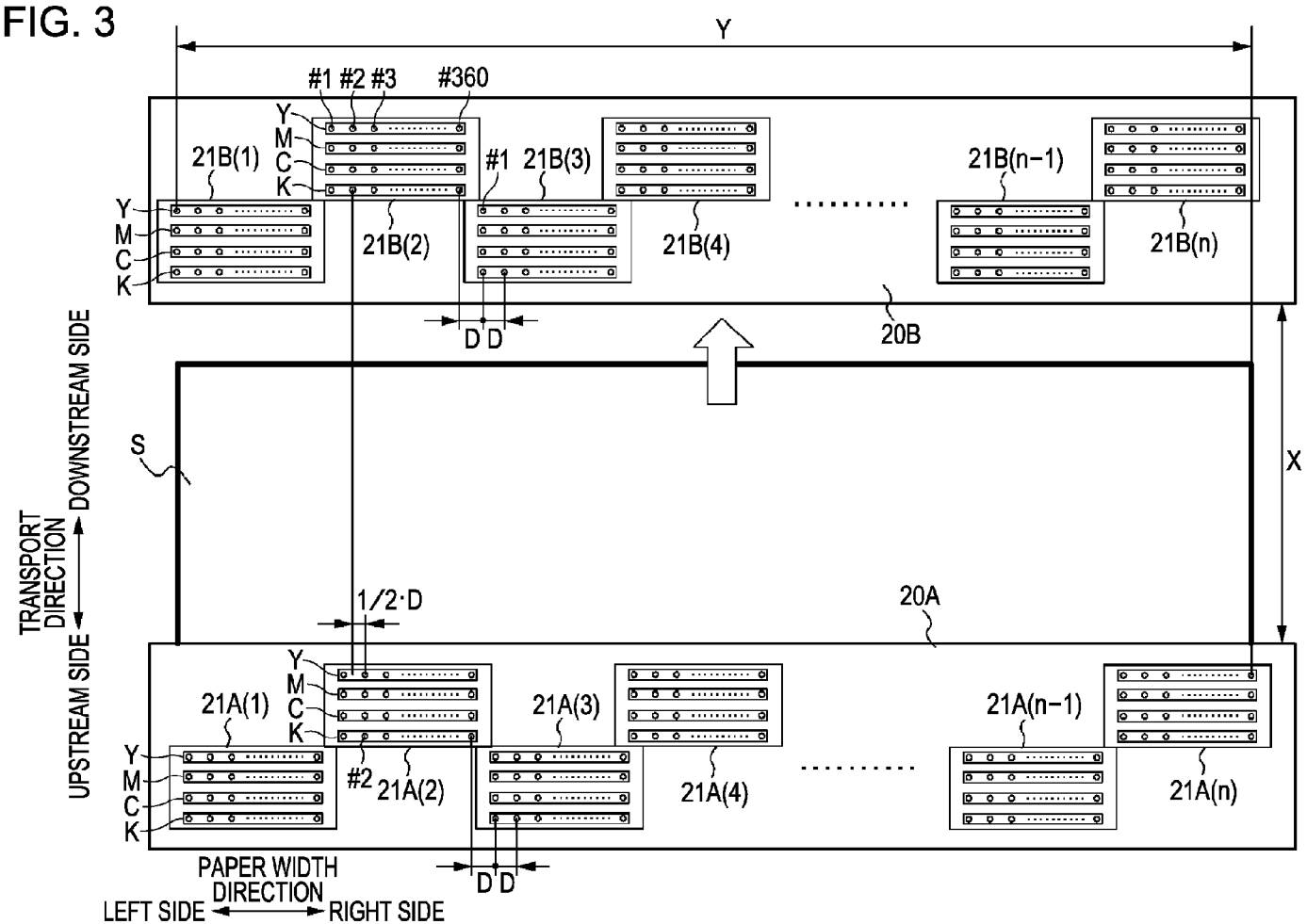
FIG. 3 is a view that shows an array of nozzles formed on the lower face of an upstream side head unit and an array of nozzles formed on the lower face of a downstream side head unit.

FIG. 3 is a view that shows an array of nozzles formed on the lower face of the upstream side head unit 20A and an array of nozzles formed on the lower face of the downstream side head unit 20B. Each of the head units 20 includes multiple (n) heads 21. Then, the multiple heads 21 are arranged in a staggered manner in a paper width direction that intersects with the transport direction. The heads that belong to the upstream side head unit 20A are denoted by 21A. The heads that belong to the downstream side head unit 20B are denoted by 21B. Then, The head are assigned with consecutive numbers in order from the left side, suffixing the number with parenthesis, that is, a first head 21(1), a second head 21(2), and the like. For example, the leftmost head of the upstream side head unit 20A is defined as an upstream side first head 21A(1).

On the lower face of each head 21, a yellow ink nozzle column Y, a magenta ink nozzle column M, a cyan ink nozzle column C, and a black ink nozzle column K are formed. Each of the nozzle columns is provided with 360 nozzles, and smaller numbers are suffixed to nozzles the more the nozzles are located at the left side in each nozzle column (#i=1 to 360). Then, the nozzles of each nozzle column are aligned at constant intervals D (nozzle pitch D) in the paper width direction.

In each of the head units 20, the heads 21 are arranged so that the interval between the nozzle #360 of a left side head 21 and the nozzle #1 of a right side head 21, which are arranged adjacently in the paper width direction, becomes the nozzle pitch D. For example, the interval between the nozzle #360 of the downstream side second head 21B(2) and the nozzle #1 of the downstream side third head 21B(3) is the nozzle pitch D. Note that the length of each nozzle column is 1 inch, and the nozzle pitch D is 360 dpi.

Accordingly, nozzles are arranged at constant intervals D in the paper width direction from the leftmost nozzle #1 of the leftmost first head 21A(1) of the upstream side head unit 20A to the right most nozzle #360 of the right most n-th head 21A(n) thereof. Similarly, nozzles are arranged at constant intervals D in the paper width direction from the leftmost nozzle #1 of the leftmost first head 21B(1) of the downstream side head unit 20B to the right most nozzle #360 of the right most n-th head 21B(n) thereof.

In addition, the nozzles of the upstream side head unit 20A are offset to the right side relative to the nozzles of the downstream side head unit 20B by a half of the nozzle pitch D (½·D). For example, the nozzle #2 of the upstream side second head 21A(2) is arranged offset to the right side relative to the nozzle #2 of the downstream side second head 21B(2) in the paper width direction by ½·D.

In the printer 1 (line head printer), a sheet of paper S is transported and printed so that the nozzle faces of the fixed head units 20 face the sheet of paper S. When the sheet of paper S is printed with a resolution of 720 dpi×720 dpi, an image of 360 dpi is printed in the paper width direction in such a manner that the sheet of paper S is passed below the upstream side head unit 20A. Then, as the sheet of paper S is passed below the downstream side head unit 20B, an image of 360 dpi is printed at a position that is offset from a position of the preceding printed image by a half nozzle pitch to the right side in the paper width direction. That is, the image of 720 dpi is printed in the paper width direction by the upstream side head unit 20A and the downstream side head unit 20B. At this time, the transport speed of the sheet of paper S is determined so that an image in the transport direction becomes 720 dpi.

Note that the head units 20 are fixed and not moved in the paper width direction, the maximum length of a sheet of paper S in the paper width direction, which is printable by the printer 1, will be a length Y. The length Y is a length from the nozzle #1 of the leftmost first head 21B(1) of the downstream side head unit 20B to the nozzle #360 of the rightmost n-th head 21A(n) of the upstream side head unit 20A.

In the present embodiment, the length Y is made greater than the long side 297 mm of A4 size sheet of paper (=210×297 mm). For example, when the length of a nozzle column is 1 inch (=25.4 mm), it means that at least twelve (297/25.4=11.7) or more head 21 are arranged in the paper width direction in each of the head units 20 in a staggered manner. Then, when A4 size sheet of paper is printed, it is only necessary to feed a sheet of paper so that the long side of the sheet is parallel to the paper width direction.

In addition, A3 size sheet of paper (=297×420), which has twice the size of A4 size sheet of paper, may be printed by feeding the short side of a sheet of paper so as to be parallel to the paper width direction. That is, the maximum size of a sheet of paper S that is printable by the printer 1 of the present embodiment is A3 size.

Driving Signal Generating Circuit 60

Figure 4:
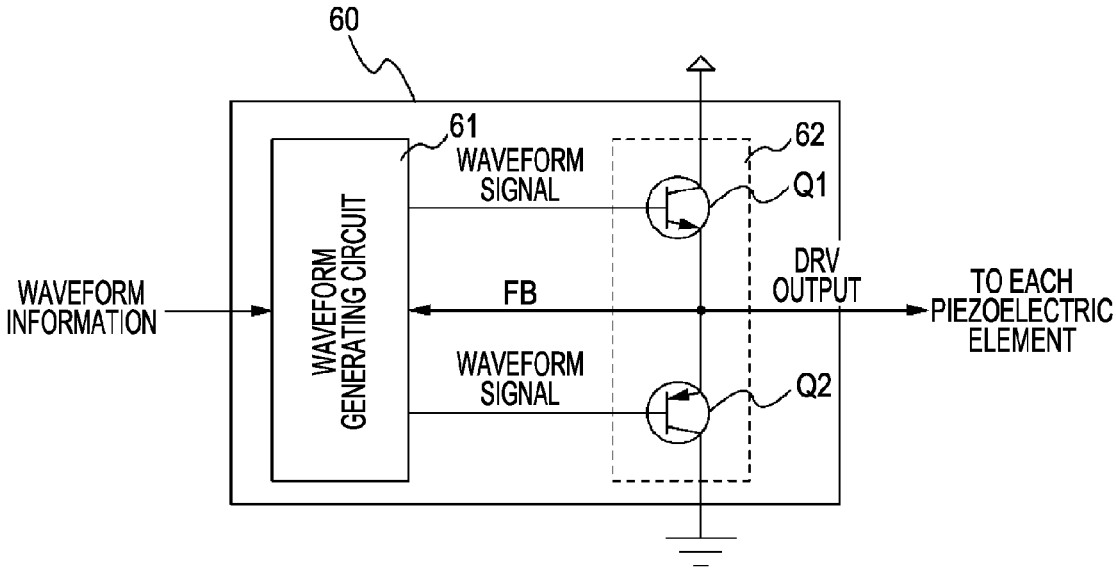
FIG. 4 is a view that shows a driving signal generating circuit.

FIG. 4 is a view that shows a driving signal generating circuit 60. The driving signal generating circuit 60 is included in the unit control circuit 54, and includes a waveform generating circuit 61 and an amplifier circuit 62. Then, in the driving signal generating circuit 60, a driving signal DRV is generated on the basis of waveform information stored in the memory 53.

The amplifier circuit 62 includes an upward transistor (NPN transistor) Q1 that operates when a voltage of the driving signal DRV rises and a downward transistor (PNP transistor) Q2 that operates when a voltage of the driving signal DRV falls. The collector of the upward transistor Q1 is connected to a power source, and the emitter of the upward transistor Q1 is connected t an output signal line of the driving signal DRV. The collector of the downward transistor Q2 is connected to a ground (earth), and the emitter of the downward transistor Q2 is connected to the output signal line of the driving signal DRV.

By the waveform generating circuit 61, waveform information, which is a digital signal, is converted into a waveform signal, which is an analog signal, and output to the amplifier circuit 62. This waveform signal controls the amplifier circuit 62. As the upward transistor Q1 enters an ON state by the waveform signal, the driving signal DRV rises. On the other hand, as the downward transistor Q2 enters an ON state by the waveform signal, the driving signal DRV falls. In this manner, the driving signal DRV is output from the connecting point on the emitter sides of the two transistors Q1 and Q2.

Note that the driving signal DRV is feedbacked (FB) to the waveform generating circuit 61. That is, the waveform generating circuit 61 generates a waveform signal in consideration of a difference between a voltage value of a target driving signal DRV and a voltage value of an actual driving signal DRV.

Driving Signal DRV and Forming of Dots

Figure 5:
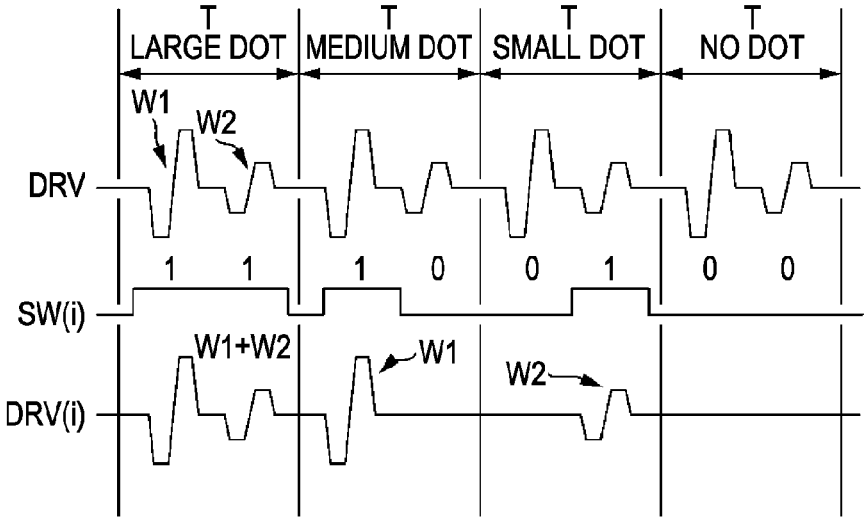
FIG. 5 is a view that shows a relationship between a driving signal and the size of a dot formed by a nozzle.

FIG. 5 is a view that shows a relationship between a driving signal DRV and the size of a dot formed by a nozzle. The driving signal DRV has a first driving pulse W1 and a second driving pulse W2. The shape of the driving pulses is determined in accordance with the amount of ink discharged from a nozzle.

Figure 6:
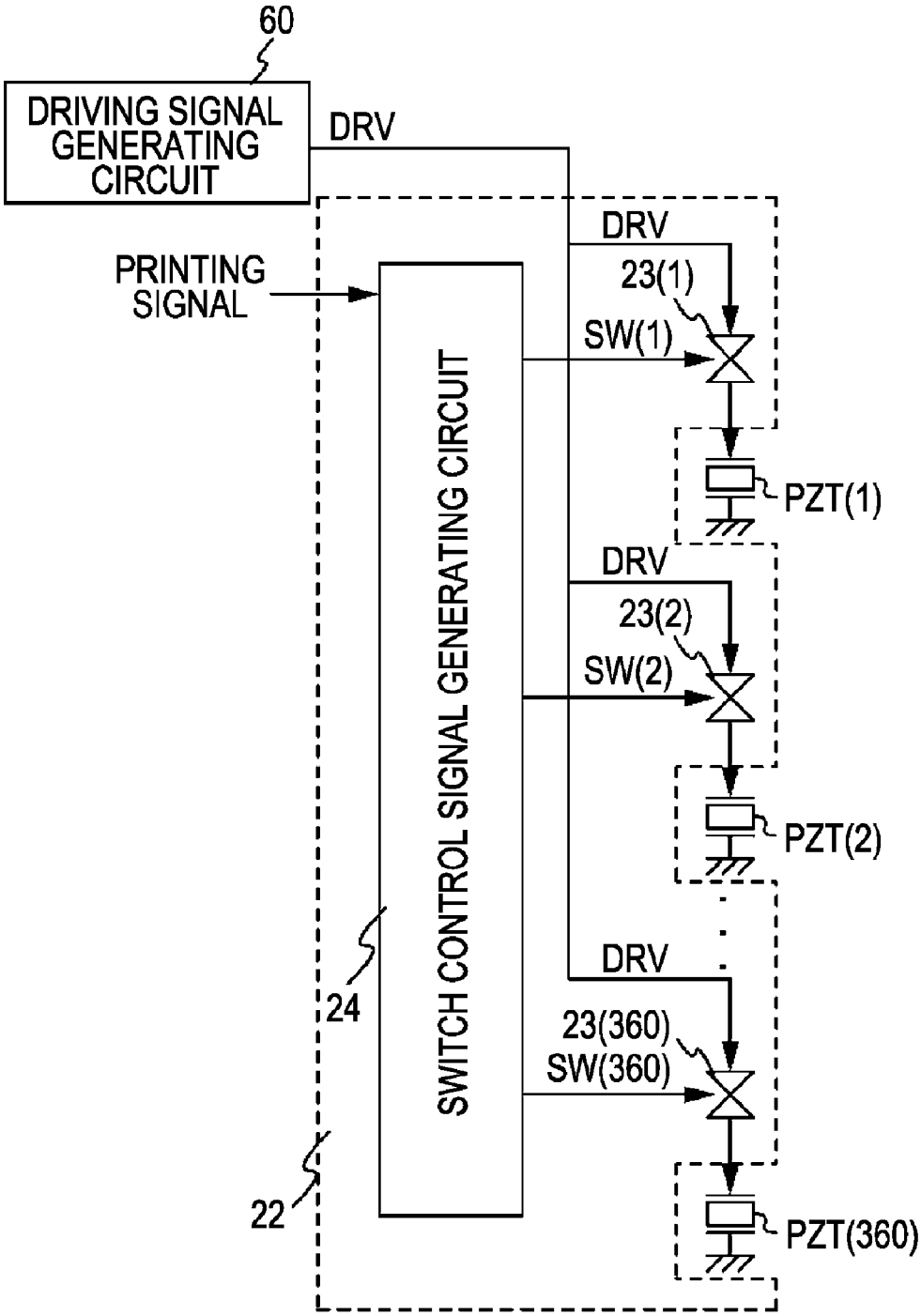
FIG. 6 is a view that shows a head driving circuit provided in a head unit.

FIG. 6 is a view that shows a head driving circuit 22 in each of the head units 20. Note that the parenthetic numeral in the drawing denotes a number of the nozzle to which a member or a signal corresponds. When a print signal is transmitted to the head driving circuit 22, the switch control signal generating circuit 24 generates a switch control signal SW(i) in accordance with image data of one pixel (a rectangular area that is virtually defined on a sheet of paper S) that is allocated to each nozzle #i. This switch control signal SW(i) executes on/off control of each switch 23(*i*) corresponding to each piezoelectric element PZT(i). Then, the on/off operation of the switch 23 applies or interrupts the driving signal DRV to the corresponding piezoelectric element PZT.

For example, when the level of the switch control signal SW(i) is "1", the switch 23(*i*) turns on and passes a driving pulse of the driving signal DRV as it is. Thus, the driving pulse is applied to the piezoelectric element PZT(i). Then, when the driving pulse is applied to the piezoelectric element PZT(i), the piezoelectric element PZT(i) deforms in accordance with the driving pulse and, thereby, an elastic film (side wall) that partly defines the ink chamber deforms, so that a prescribed amount of ink in the ink chamber is discharged from the nozzle #i. On the other hand, when the level of the switch control signal SW(i) is "0", the switch 23(*i*) turns off and blocks the driving pulse of the driving signal DRV.

As shown in FIG. 5, when the switch control signal SW(i) is "11", the first driving pulse W1 and the second driving pulse W2 are applied to the piezoelectric element PZT(i). Then, a prescribed amount of ink is discharged from the nozzle #i, and a large dot is formed. Similarly, when the switch control signal SW(i) is "10", a medium dot is formed. When the switch control signal SW(i) is "01", a small dot is formed. Furthermore, when the switch control signal SW(i) is "00", no driving pulse is applied to the piezoelectric element PZT(i), so that the piezoelectric element PZT(i) does not deform and, as a result, no dot is formed.

Driving Signal DRV and Power Consumption

Figure 7:
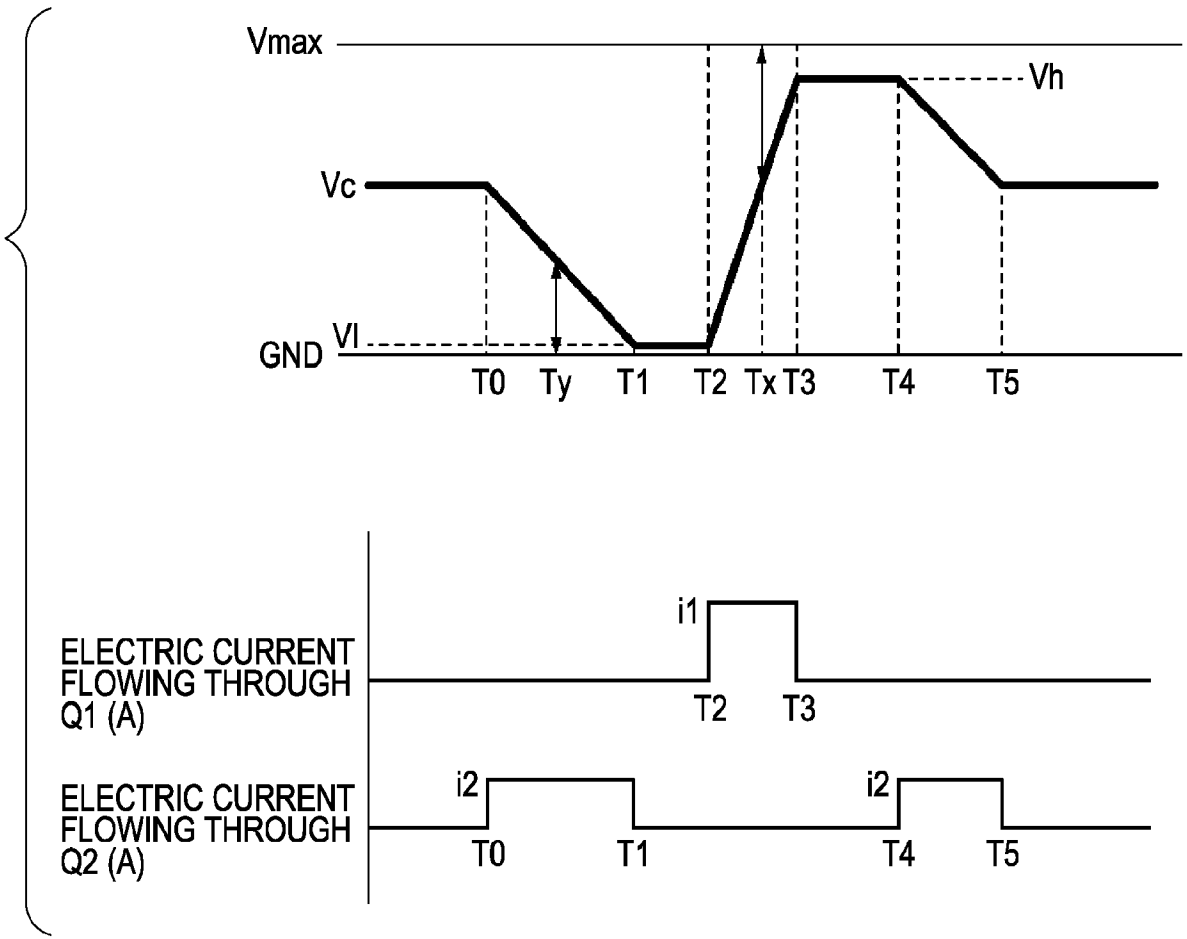
FIG. 7 is a view that illustrates changes in voltage of a first driving pulse output from the driving signal generating circuit and changes in electric current flowing through transistors.

FIG. 7 is a view that illustrates changes in voltage of the first driving pulse W1 output from the driving signal generating circuit 60 and changes in current flowing through transistors Q1 and Q2. Hereinafter, a relationship between a driving pulse and power consumption will be described by taking the first driving pulse W1 for example.

The driving signal generating circuit 60 maintains an intermediate voltage Vc until the time T0. Then, between the time T0 and the time T1, the driving signal generating circuit 60 reduces a voltage from the intermediate voltage Vc to the minimum voltage V1. At this time, the downward transistor Q2 enters an ON state, and an electric current i2(A) flows through the downward transistor Q2. Then, the piezoelectric element PZT expands the volume of the ink chamber.

After that, the driving signal generating circuit 60, after maintaining the minimum voltage V1 until the time T2, increases the voltage to the maximum voltage Vh between the time T2 to the time T3. At this time, the upward transistor Q1 enters an ON state, and an electric current i1(A) flows through the upward transistor Q1. Then, the piezoelectric element PZT discharges ink droplets from the nozzle by contracting the volume of the ink chamber.

Finally, the driving signal generating circuit 60 maintains the maximum voltage Vh until the time T4 and reduces the voltage to the intermediate voltage Vc between the time T4 and the time T5. At this time, the downward transistor Q2 enters an ON state, and an electric current i2(A) flows through the downward transistor Q2. Then, the piezoelectric element PZT expands the volume of the ink chamber to return the volume of the ink chamber to an original volume.

In this manner, when the first driving pulse W1 is applied to the piezoelectric element PZT, electric current flows through the upward transistor Q1 and the downward transistor Q2. Thus, power is consumed.

An electric current i1(A) flows through the upward transistor Q1 between the time T2 and the time T3. Therefore, power consumed at time Tx between the time T2 and the time T3 may be calculated by multiplying the electric current i1(A) by a difference in potential between the potential of the driving signal DRV at the time Tx and a power source potential Vmax. Then, the sum of power consumption from the time T2 to the time T3 is an electric energy q1 (Wh) consumed by the upward transistor Q1 when the first driving pulse W1 is applied to the piezoelectric element PZT.

An electric current i2(A) flows through the downward transistor Q2 between the time T0 and the time T1 and between the time T4 and the time T5. Therefore, power consumption at time Ty between the time T0 and the time T1 or between the time T4 and the time T5 is calculated by multiplying the electric current i2(A) by a difference in potential between the driving signal DRV at the time Ty and a ground (GND) potential. Then, the sum of power consumption from the time T0 to the time T1 and from the time T4 to the time T5 is an electric energy q2 (Wh) consumed by the downward transistor Q2 when the first driving pulse W1 is applied to the piezoelectric element PZT.

That is, an electric energy consumed when the first driving pulse W1 is applied to a single piezoelectric element PZT is q1+q2 (Wh), which is obtained by adding the electric energy q1 (Wh) consumed by the upward transistor Q1 and the electric energy q2 (Wh) consumed by the downward transistor Q2. Note that a period of time during which the driving pulse W is applied to the piezoelectric element PZT (in FIG. 7, from T0 to T5) is minute. Therefore, it is conceivable that power consumption increases at a moment when the driving pulse W is applied to the piezoelectric element PZT.

Then, an electric energy consumed when the first driving pulse W1 is applied to N numbers of the piezoelectric elements PZT at the same time is (q1+q2)×N (Wh). That is, at a moment when the first driving pulse W1 is applied to the large numbers of the piezoelectric elements PZT at the same time, power consumption rapidly increases. Thus, as the number of nozzles that discharge ink at the same time increases, power consumption increases.

Note that a medium dot and a small dot are formed so that respective driving pulses are applied to the piezoelectric element PZT; however, a large dot is formed so that two driving pulses (W1 and W2) are applied to the piezoelectric element PZT. Therefore, power consumed when a large dot is formed is larger than power consumed when a medium dot or a small dot is formed. That is, as the number of nozzles that form a large dot at the same time increases, power consumed at that time increases.

Head Unit Interval

Head Unit Interval: First Application Example

Figure 8:
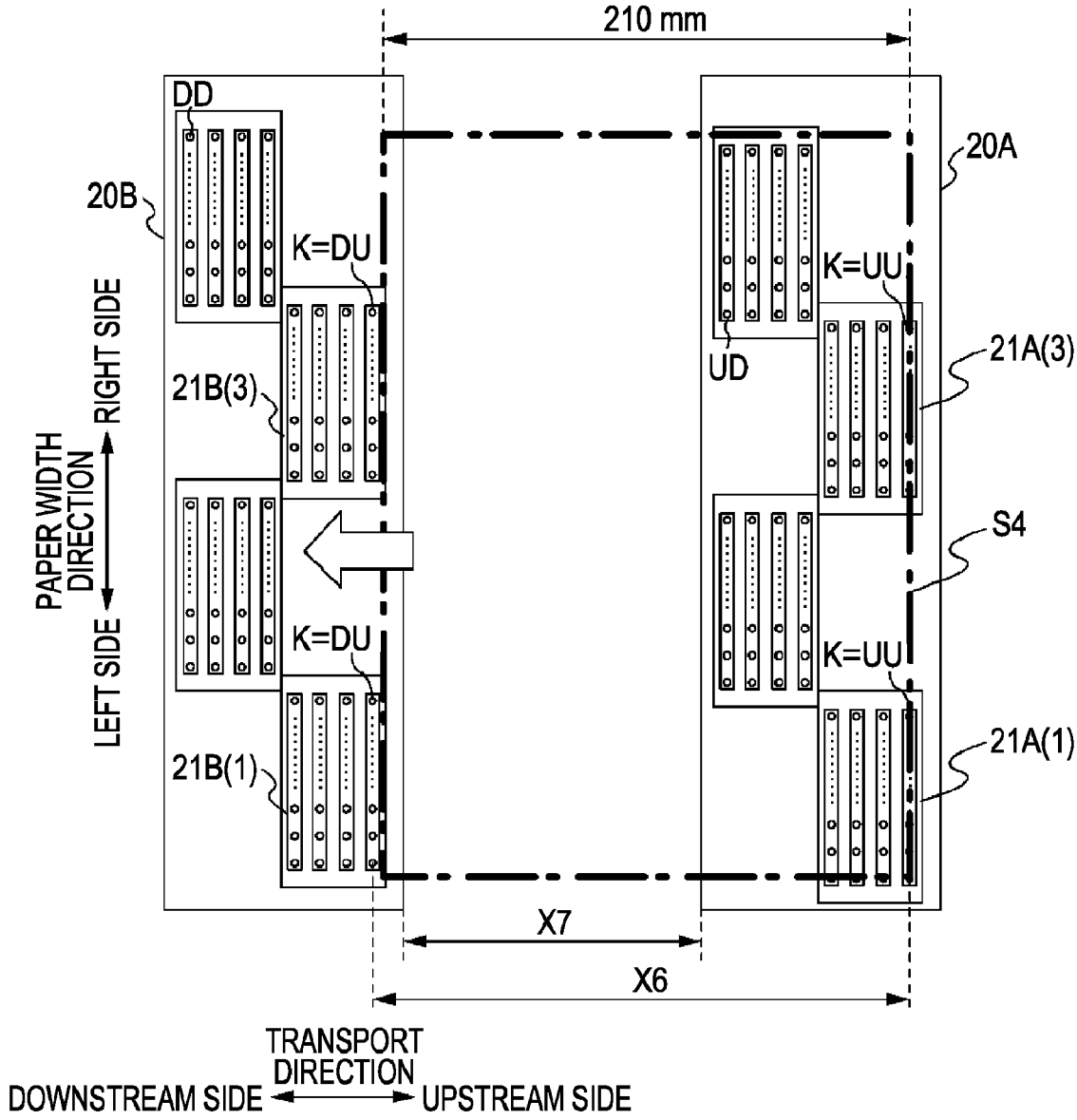
FIG. 8 is a plan view of a head unit interval of a first application example.

FIG. 8 is a plan view of the head unit interval X7 of the first application example. A4 size sheet of paper S4 is indicated by bold alternate long and short dash line. For description, the A4 size sheet of paper S4 is used for printing with a resolution of 720 dpi in the paper width direction using both the upstream side head unit 20A and the downstream side head unit 20B. Note that, where the length of a nozzle column is 1 inch, when printing is performed on A4 size sheet of paper, the number of heads that are arranged in the paper width direction is twelve; however, the number of heads is four for easier description in the drawing (hereinafter, the same applies to the other examples).

In the first application example, the interval X6 is set between the most upstream side nozzle columns (K column of the head 21A(1) or the head 21A(3), hereinafter referred to as "UU") of the upstream side head unit 20A and the most upstream side nozzle columns (K column of the head 21B(1) or the head 21B(3), hereinafter, referred to as "DU") of the downstream side head unit 20B, and the head unit interval X7 is set so as to be greater than the length of the short side of the A4 size sheet of paper S4.

Figure 9A:
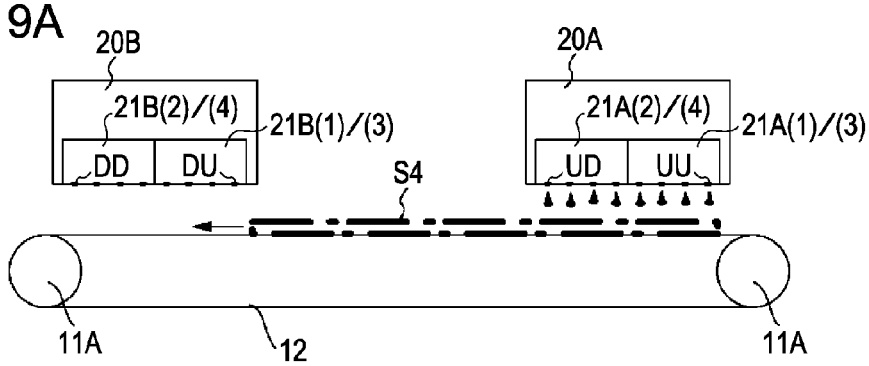
FIG. 9A is a view that shows a state where printing is performed on the rear end side of an A4 size sheet of paper by the upstream side head unit.

FIG. 9A is a view that shows a state where printing is performed on the rear end side of A4 size sheet of paper S4 by the upstream side head unit 20A. When the rear end of the A4 size sheet of paper S4 faces the most upstream side nozzle columns UU of the upstream side head unit 20A, the front end of the A4 size sheet of paper S4 does not face the nozzle columns of the downstream side head unit 20B. That is, at this time, the maximum number of nozzle columns that face the A4 size sheet of paper at the same time is sixteen columns (=4 columns×4) that is equal to the number of nozzle columns included in each head unit.

Figure 9B:
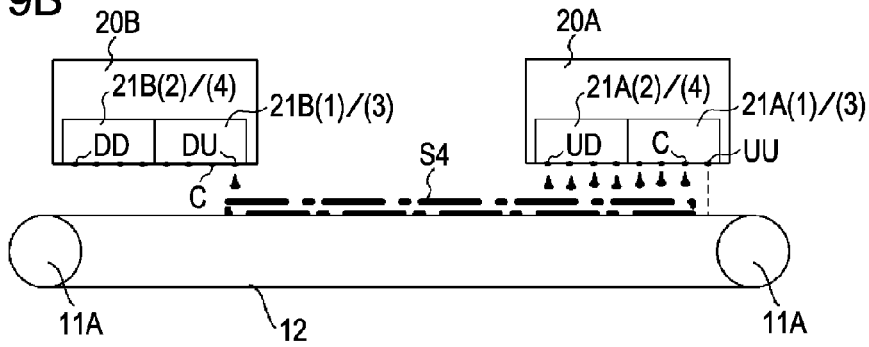
FIG. 9B is a view that shows a state where printing is performed on the front end side and rear end side of an A4 size sheet of paper by the upstream side head unit and the downstream side head unit.

FIG. 9B is a view that shows a state where printing is performed on the front end side and rear end side of A4 size sheet of paper S4 by the upstream side head unit 20A and the downstream side head unit 20B. After the rear end of the A4 size sheet of paper is passed below the most upstream side nozzle columns UU of the upstream side head unit 20A, the most upstream side nozzle columns DU of the downstream side head unit 20B face the front end of the A4 size sheet of paper. That is, after the rear end of the A4 size sheet of paper is passed below m-th nozzle columns of the upstream side head unit 20A, the m-th nozzle columns of the downstream side head unit 20B face the front end side of the A4 size sheet of paper. Therefore, at this time, the maximum number of nozzle columns that face the A4 size sheet of paper at the same time is sixteen columns equal to the number of nozzle columns included in each head unit.

Figure 9C:
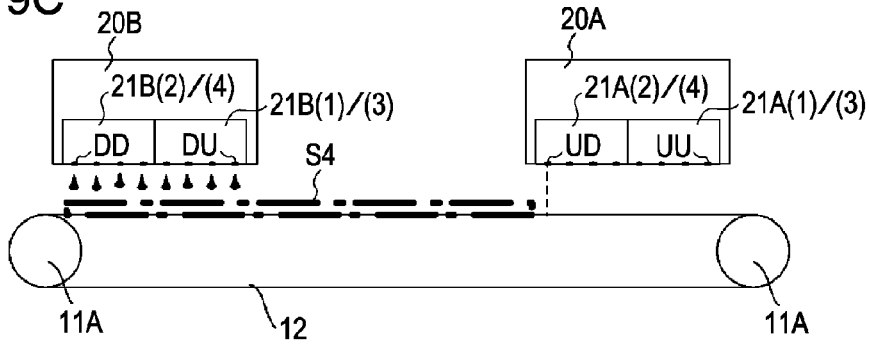
FIG. 9C is a view that shows a state where printing is performed on the front end side of an A4 size sheet of paper by the downstream side head unit.

FIG. 9C is a view that shows a state where printing is performed on the front end side of A4 size sheet of paper by the downstream side head unit 20B. When the A4 size sheet of paper faces all the nozzle columns of the downstream side head unit 20B, the nozzle columns of the upstream side head unit 20A do not face the A4 size sheet of paper. Therefore, at this time, the maximum number of nozzle columns that face the A4 size sheet of paper at the same time is sixteen columns equal to the number of nozzle columns included in each head unit.

That is, the head unit interval X7 of the first application example is set so that the maximum number of nozzle columns that face the A4 size sheet of paper at the same time is sixteen columns equal to the number of nozzle columns included in each head unit.

Figure 10:
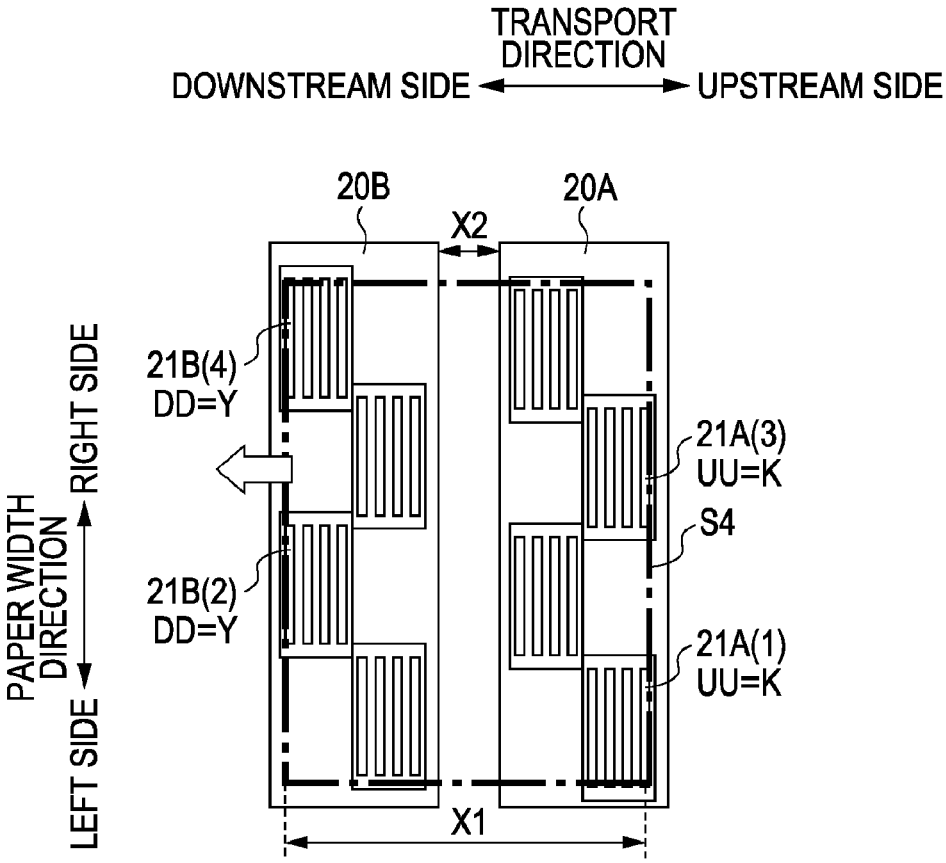
FIG. 10 is a view that shows a first comparative example of which an interval is reduced as compared with the head unit interval of the first application example.

FIG. 10 is a view that shows a first comparative example of which an interval is reduced as compared with the head unit interval X7 of the first application example. The head unit interval X2 of the first comparative example is set so that the interval X1 between the most upstream side nozzle columns UU of the upstream side head unit and the most downstream side nozzle columns of the downstream side head unit (Y column of the head 21B(2) or the head 21B(4), hereinafter, referred to as "DD") is equal to the length of the short side of the A4 size sheet of paper S4. Therefore, in midway of printing, A4 size sheet of paper faces all the nozzle columns (32 columns=4 columns×8) of the upstream side head unit 20A and downstream side head unit 20B.

Incidentally, as the number of nozzles that form dots at the same time, power consumption increases, as described above. In addition, even in the nozzles that form dots, as the number of nozzles that form large dots increases, power consumption increases.

Therefore, in the first comparative example, power consumed when ink (large dots) is discharged from all the nozzles of 32 nozzle columns that face the A4 size sheet of paper at the same time is the maximum power consumption. Similarly, in the first application example, power consumed when ink (large dots) is discharged from all the nozzles of 16 nozzle columns that face the A4 size sheet of paper at the same time is the maximum power consumption. That is, the maximum power consumption of the first comparative example is twice the maximum power consumption of the first application example.

When the maximum power consumption is large as in the case of the first comparative example, there is a possibility that a voltage of the power source portion largely reduces. In this case, a power failure detection circuit erroneously detects a power failure and printing operation may be stopped. In order to avoid the above trouble, a method in which a large capacity power source is used is employed when the maximum power consumption is large. However, a large capacity power source is large in shape and expensive.

Then, as in the case of the first application example, the head unit interval X7 is set so that the interval X6 between the most upstream side nozzle columns UU of the upstream side head unit and the most upstream side nozzle columns DU of the downstream side head unit is greater than the short side of the A4 size sheet of paper. In this case, the number of maximum nozzle columns that face the A4 size sheet of paper at the same time is sixteen columns equal to the number of nozzle columns included in each head unit, so that the maximum power consumption is half the maximum power consumption of the first comparative example. Therefore, a trouble, such as interruption of printing operation because of voltage drop, is eliminated and, as a result, it is unnecessary to use a large capacity power source.

In addition, irrespective of the size of the head unit interval, the A4 size sheet of paper definitely faces all the nozzle columns (sixteen nozzles) included in each head unit at the same time. Therefore, the printer 1 needs to have at least a power source that can allow power consumption when ink (large dots) is discharged at the same time from all the nozzle columns included in each of the head unit 20. Therefore, in the present embodiment, the head unit interval is set so that the maximum number of nozzle columns that face the A4 size sheet of paper S4 at the same time does not exceed sixteen columns equal to the number of nozzle columns included in each head unit 20.

Head Unit Interval: Second Application Example

Figure 11A:
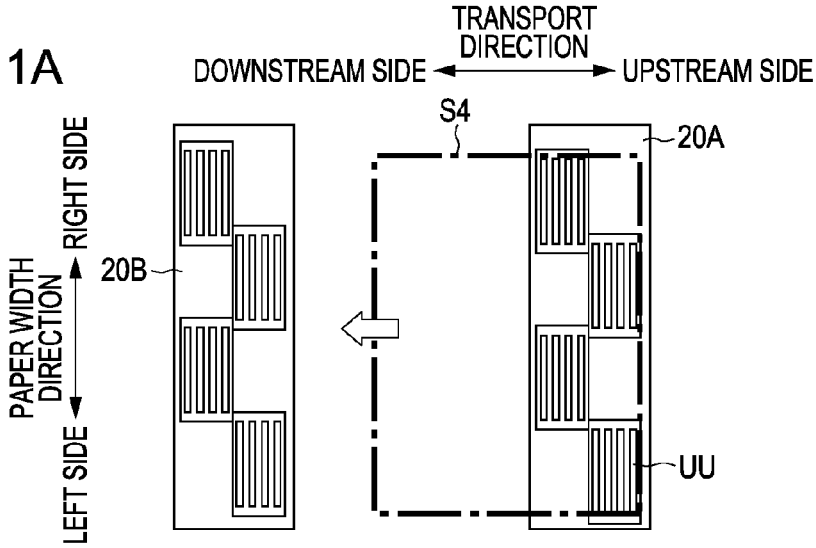
FIG. 11A to FIG. 11C are views that show a head unit interval of a second application example.
Figure 11B:
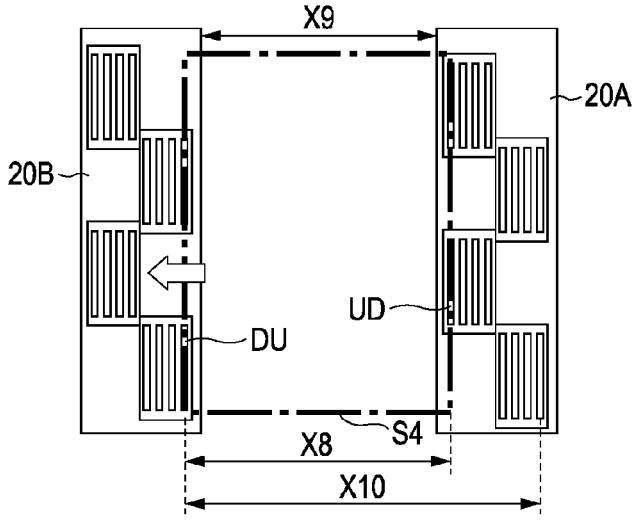
Figure 11C:
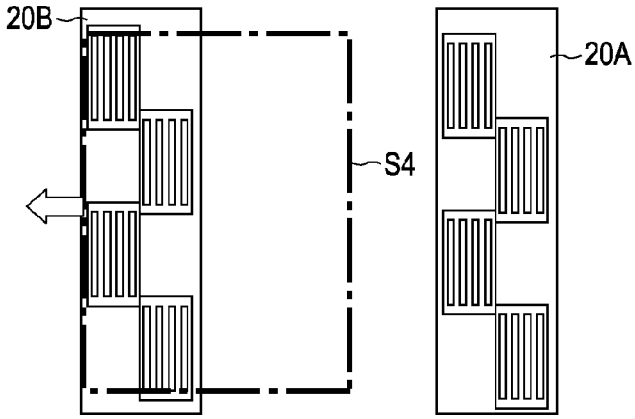

FIG. 11A to FIG. 11C are views that show a head unit interval X8 of a second application example. In the second application example, as shown in FIG. 11B, the head unit interval X9 is set so that the most downstream side nozzle columns UD of the upstream side head unit and the most upstream side nozzle columns DU of the downstream side head unit is equal to the length of the short side of the A4 size sheet of paper S4.

In the initial stage of printing (FIG. 11A), only the upstream side head unit 20A is used. In the last stage of printing (FIG. 11C), only the downstream side head unit 20B is used. Then, in the midway of printing (FIG. 11B), when the rear end of the A4 size sheet of paper S4 faces the most downstream side nozzle columns UD of the upstream side head unit, the front end of the A4 size sheet of paper S4 faces the most upstream side nozzle columns DU of the downstream side head unit.

That is, the head unit interval X9 of the second application example is set so that the maximum number of nozzle columns that face the A4 size sheet of paper at the same time is sixteen columns equal to the number of nozzle columns included in each head unit. Then, the maximum power consumption of the second application example is half the maximum power consumption of the first comparative example, so that the same advantageous effects as in the case of the first application example are obtained.

Figure 12:
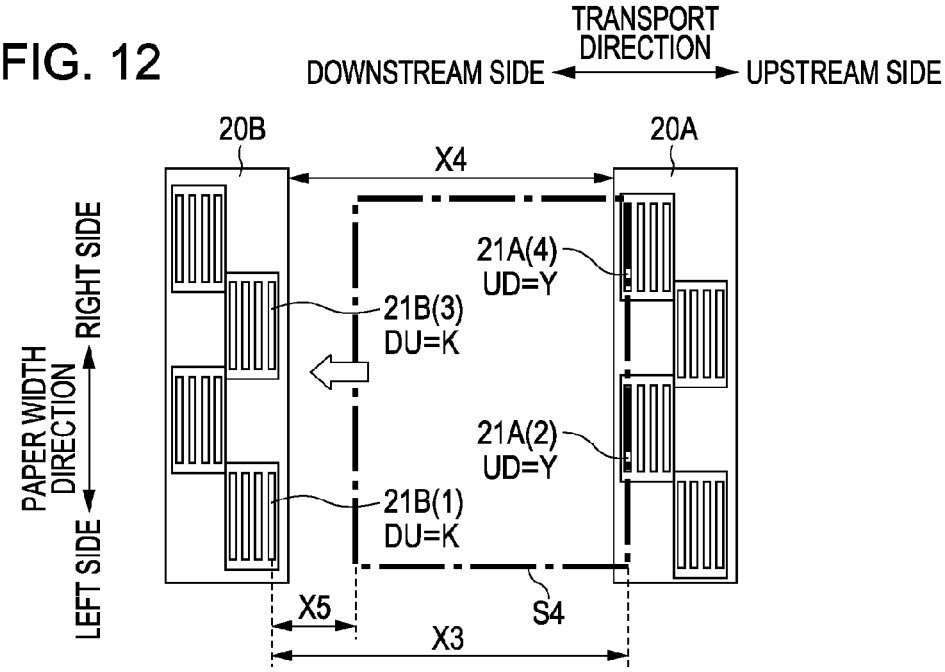
FIG. 12 is a view of a second comparative example of which an interval is increased as compared with the head unit interval of the second application example.

FIG. 12 is a view of a second comparative example of which an interval is increased as compared with the head unit interval X9 of the second application example. In the second comparative example, the head unit interval X4 is set so that the interval X3 between the most downstream side nozzle columns UD of the upstream side head unit and the most upstream side nozzle columns DU of the downstream side head unit is greater than the length of the short side of the A4 size sheet of paper S4. In this case, between the time when the rear end of the A4 size sheet of paper is passed below the upstream side head unit 20A to the time when the front end of the A4 size sheet of paper faces the nozzles of the downstream side head unit 20B (X5), the A4 size sheet of paper is only transported and no printing is performed thereon. By performing such an useless transport, transport time (printing time) becomes long, and the size of the apparatus becomes large.

In contrast, in the second application example, before the rear end of the A4 size sheet of paper is passed below the most downstream side nozzle columns UD of the upstream side head unit, the front end of the A4 size sheet of paper face the most upstream side nozzle columns DU of the downstream side head unit. Therefore, in the second application example, there is no period of time when the A4 size sheet of paper does not face the nozzle columns on the transport belt 12 and, hence, there is no useless transport period.

That is, because the head unit interval X9 of the second application example (FIG. 11B) is set so that the interval X8 between the most downstream side nozzle columns UD of the upstream side head unit and the most upstream side nozzle columns DU of the downstream side head unit is equal to or smaller than the length of the short side of the A4 size sheet of paper, the maximum power consumption may be reduced as compared with the first comparative example and the size of the apparatus may be reduced as compared with the second comparative example as much as possible.

Summary of Setting Method

When the setting method of the head unit interval according to the present embodiment is summarized, the head unit interval is set so that (1) the interval between the most upstream side nozzle columns UU of the upstream side head unit (upstream side nozzle group) and the most upstream side nozzle columns DU of the downstream side head unit (downstream side nozzle group) is greater than the length of the short side (length in the transport direction) of a sheet of paper of A4 size (the maximum size to which liquid can be discharged) and (2) the interval between the most downstream side nozzle columns UD of the upstream side head unit and the most upstream side nozzle columns DU of the downstream side head unit is equal to or smaller than the length of the short side of the A4 size sheet of paper.

By setting the head unit interval in conformity to the above condition, there is no possibility that the maximum number of nozzle columns that may possibly be used at the same time does not exceed the number of nozzle columns (sixteen columns) included in each head unit 20, and, hence, it is possible to suppress the maximum power consumption to a certain value. In addition, because there is no useless transport period of time, it is possible to shorten transport time (printing time) and also possible to reduce the size of the apparatus.

First Print Method and Second Print Method

Figure 13:
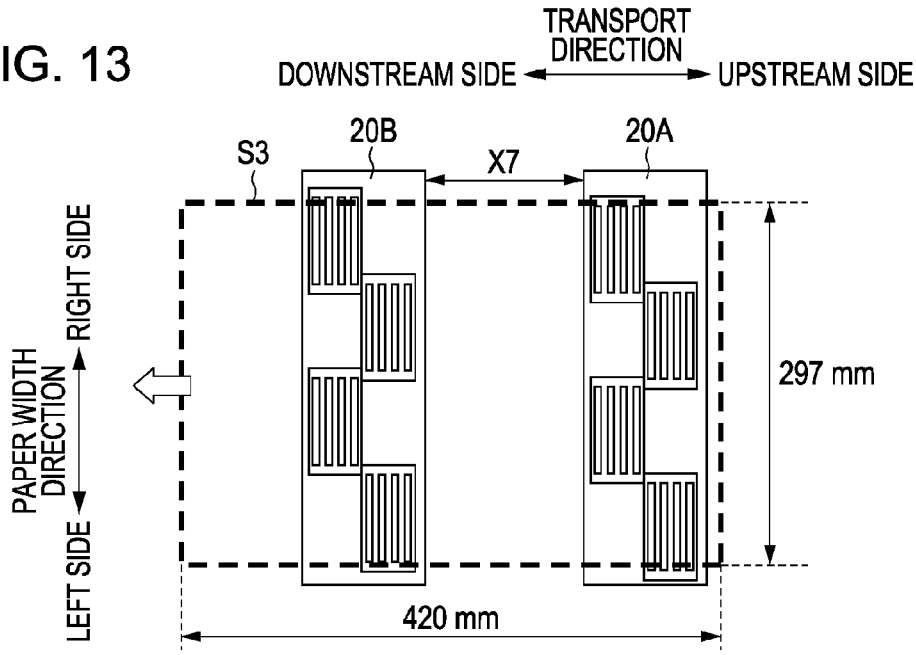
FIG. 13 is a view that shows a state where printing is performed on an A3 size sheet of paper using the head unit interval of the first application example.

FIG. 13 is a view that shows a state where printing is performed on an A3 size sheet of paper using the head unit interval X7 of the first application example. The short side (297 mm) of the A3 size sheet of paper S3 is made as the length in the paper width direction, and the long side (420 mm) of the A3 size sheet of paper S3 is made as the length in the transport direction, and then printing is performed on the A3 size sheet of paper S3.

The head unit interval X7 of the first application example is set so that the short side (210 mm) of the A4 size sheet of paper S4 is used as a reference. Then, the length of the A3 size sheet of paper S3 in the transport direction (420 mm) is twice the length of the A4 size sheet of paper S4 in the transport direction (210 mm). Therefore, as shown in FIG. 13, the A3 size sheet of paper S3 faces all the 32 nozzle columns of the upstream side head unit 20A and downstream side head unit 20B in midway of printing.

If ink (large dots9 is discharged from all the nozzles of the 32 nozzle columns that face the A3 size sheet of paper at the same time, the maximum power consumption at this time is equal to the maximum power consumption of the above described first comparative example. Hence, there may be a trouble that printing operation is stopped, for example.

In the present embodiment, when printing is performed on the A3 size sheet of paper using the head unit interval (first application example and second application example) that is set using the short side of the A4 size sheet of paper as a reference, it is directed to suppress the maximum power consumption to be lower than "limit power consumption". Here, power consumed when ink (large dots) is discharged from all the 16 nozzle columns included in each head unit at the same time is termed as "limit power consumption". That is, the limit power consumption is equal to the maximum power consumed when printing is performed on an A4 size sheet of paper.

In addition, irrespective of the size of the head unit interval, the printer 1 needs to have at least a power source that can allow power consumption when ink (large dots) is discharged from all the nozzle columns included in each head unit at the same time. That is, when the maximum power consumption during printing does not exceed the limit power consumption, it is only necessary for the printer 1 to include a minimum capacity power source.

Meanwhile, even when the maximum number of nozzle columns that face the sheet at the same time exceeds sixteen columns as in the case of the A3 size sheet of paper, it is possible to suppress the maximum power consumption to be equal to or lower than the limit power consumption when the number of nozzle columns that discharge ink does not exceed sixteen columns. Then, in the present embodiment, two print methods are used. The two print methods includes a first print method in which the timing at which ink is discharged from the nozzles of the upstream side head unit 20A is the same as the timing at which ink is discharged from the nozzles of the downstream side head unit 20B, and a second print method in which the timing at which ink is discharged from the nozzles of the upstream side head unit 20A is delayed from the timing at which ink is discharged from the nozzles of the downstream side head unit 20B and ink is discharged alternately. Hereinafter, a difference between the first print method and the second print method will be described.

Figure 14:
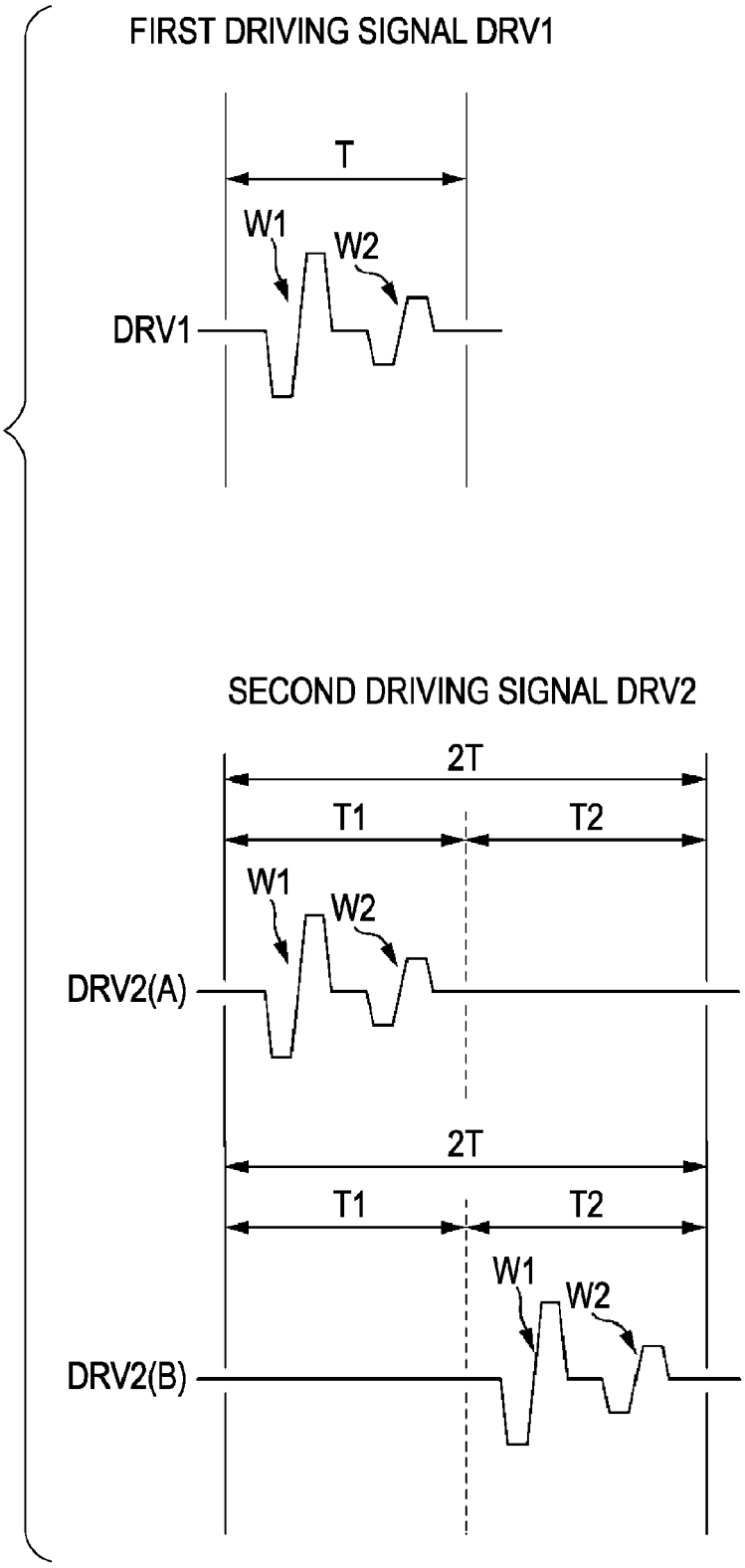
FIG. 14 is a view that shows a first driving signal and a second driving signal.

FIG. 14 is a view that shows a first driving signal DRV1 and a second driving signal DRV2. The first driving signal DRV1 is used for the first print method. The second driving signal DRV2 is used for the second print method.

The first driving signal DRV1 is used in the first print method. The first driving signal DRV1 has one of each of a first driving pulse W1 and a second driving pulse W2 within a cycle period T. Then, in accordance with print data, ink is discharged from each nozzle at an interval of the cycle period T. Therefore, the time during which one pixel of a printing sheet of paper faces the nozzle #i is a duration of the cycle period. Specifically, when the resolution in the transport direction is 720 dpi, the size of a pixel in the transport direction is 1/720 inch. Hence, in the first print method, the transport unit 10 transports a printing sheet of paper so that the printing sheet of paper travels 1/720 inch during a duration of the cycle period T. The transport speed of this first print method is set to 2V in this embodiment. Note that the driving signal DRV shown in FIG. 5 is the first driving signal DRV1.

Further, the first driving signal DRV1 is of a single type, and is commonly used for the upstream side head unit 20A and the downstream side head unit 20B. Therefore, in midway of printing, even when the sheet of paper S faces both the upstream side head unit 20A and the downstream side head unit 20B, ink is discharged at the same time from the nozzles of the upstream side head unit 20A and from the nozzles of the downstream side head unit 20B in accordance with print data.

In contrast, the second driving signal DRV2 is formed of two types. This is because a driving signal used for the upstream side head unit 20A (hereinafter, referred to as upstream side driving signal DRV2(A)) is different from a driving signal used for the downstream side head unit 20B (hereinafter, referred to as downstream side driving signal DRV2(B)).

Both driving signals (DRV2(A), DRV2(B)) have the same cycle period, which is 2T. Then, the time during which one pixel of a printing sheet of paper faces the nozzle #i is the cycle period 2T. Hence, in the second print method, the transport unit 10 transports a printing sheet of paper so that the printing sheet of paper travels 1/720 inch during the cycle period 2T. The transport speed of the second print method is set to V. That is, the transport speed V of the second print method is half the transport speed 2V of the first print method.

Further, each of the driving signals (DRV2(A) DRV2(B)) has one of each first driving pulse W1 and second driving pulse W2. However, the upstream side driving signal DRV2(A) has two driving pulses (W1, W2) in a first half period T1 within the cycle period 2T, while the downstream side driving signal DRV2(B) has two driving pulses in a second half period T2 within the cycle period 2T. Hence, from the nozzles of the upstream side head unit 20A that uses the upstream side driving signal DRV2(A), ink is discharged in the first half period T1 within the cycle period 2T. In contrast, from the nozzles of the downstream side head unit 20B that uses the downstream side driving signal DRV2(B), ink is discharged in the second half period T2 within the cycle period 2T.

Thus, in the second print method, by delaying the period during which the driving signal has a driving pulse within the cycle period, ink is alternately discharged from the nozzles of the upstream side head unit 20A and from the nozzles of the downstream side head unit 20B.

Accordingly, first, the controller 50 of the printer 1 receives, from the computer 30, an instruction for performing printing in the first print method or in the second print method. When the controller 50 receives an instruction for performing printing in the first print method, the controller 50 controls the transport unit 10 so that the transport speed becomes 2V. In addition, the controller 50 instructs the driving signal generating circuit 60 of the upstream side head unit 20A and the driving signal generating circuit 60 of the downstream side head unit 20B to generate a common first driving signal DRV1.

On the other hand, when the controller 50 receives an instruction for performing printing in the second print method, the controller 50 controls the transport unit 10 so that the transport speed becomes V. In addition, the controller 50 instructs the driving signal generating circuit 60 of the upstream side head unit 20A to generate the upstream side driving signal DRV2(A) and instructs the driving signal generating circuit 60 of the downstream side head unit 20B to generate the downstream side driving signal DRV2(B).

For example, as shown in FIG. 13, the second print method is used for performing printing on an A3 size sheet of paper using the head unit interval X7 of the first application example. That is, printing is performed on the A3 size sheet of paper by alternately discharging ink from the nozzles of the upstream side head unit 20A and from the nozzles of the downstream side head unit 20B. In this manner, as shown in FIG. 13, even when the A3 size sheet of paper faces all the 32 nozzle columns of the upstream side head unit 20A and the downstream side head unit 20B in midway of printing, the maximum number of nozzle columns that discharge ink at the same time is sixteen columns, so that there is no possibility that the maximum power consumption exceeds the limit power consumption.

Moreover, as shown in FIG. 8, the first print method is used for performing printing on an A4 size sheet of paper using the head unit interval X7 of the first application example. That is, by discharging ink at the same time from the nozzle columns of the upstream side head unit 20A and the downstream side head unit 20B, both of which face the A4 size sheet of paper at the same time, printing is performed on the A4 size sheet of paper. When printing is performed on the A4 size sheet of paper using the head unit interval X7 of the first application example, because the maximum number of nozzle columns that face the sheet of paper at the same time does not exceed sixteen columns, so that the maximum power consumption does not exceed the limit power consumption. On the contrary, printing is performed on the A4 size sheet of paper using the head unit interval X7 of the first application example in the second print method, printing time will be twice the printing time of the first print method.

Then, in the present embodiment, the transport speed is varied in accordance with "the number of nozzle columns used", and the first print method and the second print method are appropriately used. Here, the "nozzle columns used" are nozzle columns that may possibly discharge ink at the same time. For example, the nozzle columns used indicate nozzle columns that face a printing sheet of paper and nozzle columns that face an area of a printing sheet of paper, on which an image is printed.

When the number of nozzle columns used is more than the number of nozzle columns included in each of the upstream side head unit 20A and the downstream side head unit 20B (predetermined number=16 columns), the transport speed is reduced and printing is performed in the second print method. That is, ink is alternately discharged from the nozzles of the upstream side head unit 20A and from the nozzles of the downstream side head unit 20B. As a result, when the maximum power consumption does not exceeds the limit power consumption, or when the number of nozzle columns used is equal to or smaller than sixteen columns, the transport speed is increased and printing is performed in the first print method. That is, ink is discharged from the nozzle columns used at the same time. As a result, it is possible to shorten printing time as much as possible.

Hereinafter, embodiments in which "nozzle columns used" are differently defined will be described in detail. Note that a determination as to whether the first print method is used or the second print method is used is performed by a printer driver stored in the memory of the computer 30. The printer driver is a program that transmits printing image data to the printer 1, for example. That is, the system in which the printer 1 and the computer 30 that stores the printer driver therein, which are connected to each other, is a liquid discharging apparatus.

First Embodiment: Determine Print Method on the Basis of Size of Printing Sheet of Paper In the first embodiment, the printer driver determines a print method on the basis of "the size of a printing sheet of paper". For description, the head unit interval of the printer 1 is the head unit interval X7 of the first application example. Then, using both the upstream side head unit 20A and the downstream side head unit 20B, printing is performed with a resolution of 720 dpi in the paper width direction.

In the head unit interval X7 of the first application example shown in FIG. 8, when the length of a printing sheet of paper in the transport direction is greater than the length (210 mm) of the short side of the A4 size sheet of paper, the front end of the printing sheet of paper faces the nozzle columns of the downstream side head unit 20B while the rear end side of the printing sheet of paper is facing the 16 nozzle columns of the upstream side head unit 20A. That is, the number of nozzle columns that face the sheet of paper at the same time exceeds sixteen columns, which is the number of nozzle columns included in each head unit. If ink is discharged from all the nozzle columns that exceed sixteen columns facing the printing sheet of paper, the maximum power consumption exceeds the limit power consumption.

Therefore, when the length of the printing sheet of paper in the transport direction is greater than the length (210 mm) of the short side of the A4 size sheet of paper, it is necessary to reduce the maximum power consumption by alternately discharging ink from the upstream side head unit 20A and from the downstream side head unit 20B. That is, when the length of the printing sheet of paper in the transport direction is greater than the length of the short side of the A4 size sheet of paper, it is possible to prevent the maximum power consumption from exceeding the limit power consumption by performing printing in the second print method.

On the contrary, when the length of the printing sheet of paper in the transport direction is equal to or smaller than the length (210 mm) of the short side of the A4 size sheet of paper, the maximum number of nozzle columns that face the sheet of paper at the same time does not exceed sixteen columns. Therefore, the maximum power consumption does not exceed the limit power consumption, and it is unnecessary to alternately discharge ink from the upstream side head unit 20A and from the downstream side head unit 20B. That is, when the length of the printing sheet of paper in the transport direction is smaller than the length of the short side of the A4 size sheet of paper, printing is performed in the first print method. By so doing, it is possible to shorten the printing time as compared with printing performed in the second print method.

Figure 15:
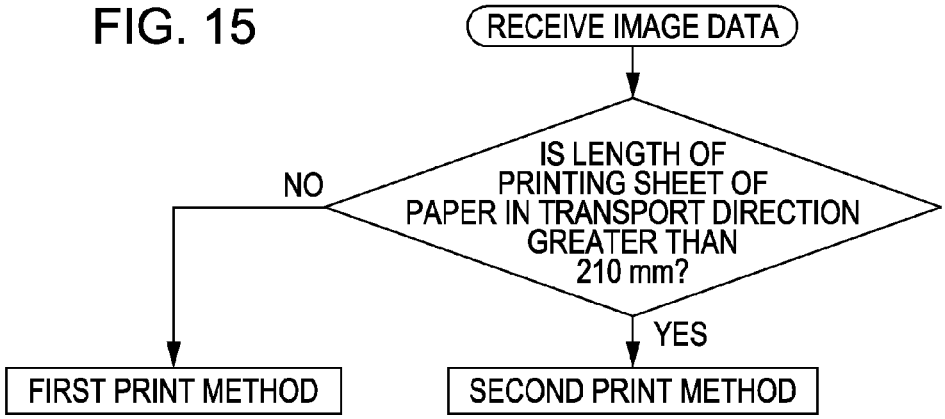
FIG. 15 is a flowchart when a printer driver determines a print method according to a first embodiment.

FIG. 15 is a flowchart that is executed when the printer driver determines a print method according to the first embodiment. First, the printer driver receives image data from various application software. Then, the printer driver determines whether the length of the specified printing sheet of paper in the transport direction is greater than the length (210 mm) of the short side of the A4 size sheet of paper.

If the length of the printing sheet of paper in the transport direction is greater than 210 mm (YES), the printer driver instructs the printer 1 so as to perform printing on a printing sheet of paper in the second print method. In addition, if the length of the printing sheet of paper in the transport direction is equal to or smaller than 210 mm (NO), the printer driver instructs the printer 1 to perform printing on a printing sheet of paper in the first print method. That is, on the basis of the length of the printing sheet of paper in the transport direction, the transport speed is determined. Note that the determined transport speed is never changed while the printing sheet of paper is being transported.

In the first embodiment as described above, the printer driver determines a print method on the basis of the "size of a printing sheet of paper", and printing is performed in the print method suitable for the size of the printing sheet of paper. Because the print method is determined on the basis of the size of a printing sheet of paper, the print method is determined on the basis of the number of nozzle columns that face the printing sheet of paper at the same time, irrespective of ink being discharged or not discharged in accordance with print data. That is, the "nozzle columns used" are nozzle columns that face the printing sheet of paper at the same time. By so doing, the maximum power consumption during printing does not exceed the limit power consumption, and it is possible to shorten the printing time as much as possible. In addition, printing may be performed on a sheet of paper, other than size (A4 size) that is used as a reference for setting the head unit interval, the types of paper size that are printable by the printer 1 are increased.

As described above, the print method is determined whether "the length of a printing sheet of paper in the transport direction is greater than 210 mm". In other words, the print method is determined on the basis of "the type (size) of a printing sheet of paper". Because the sizes of almost all printing sheets of paper are determined in advance according to a standard, so that it is possible to determine a print method on the basis of "the type of a printing sheet of paper" at the time when the head unit interval is set.

Figure 16:
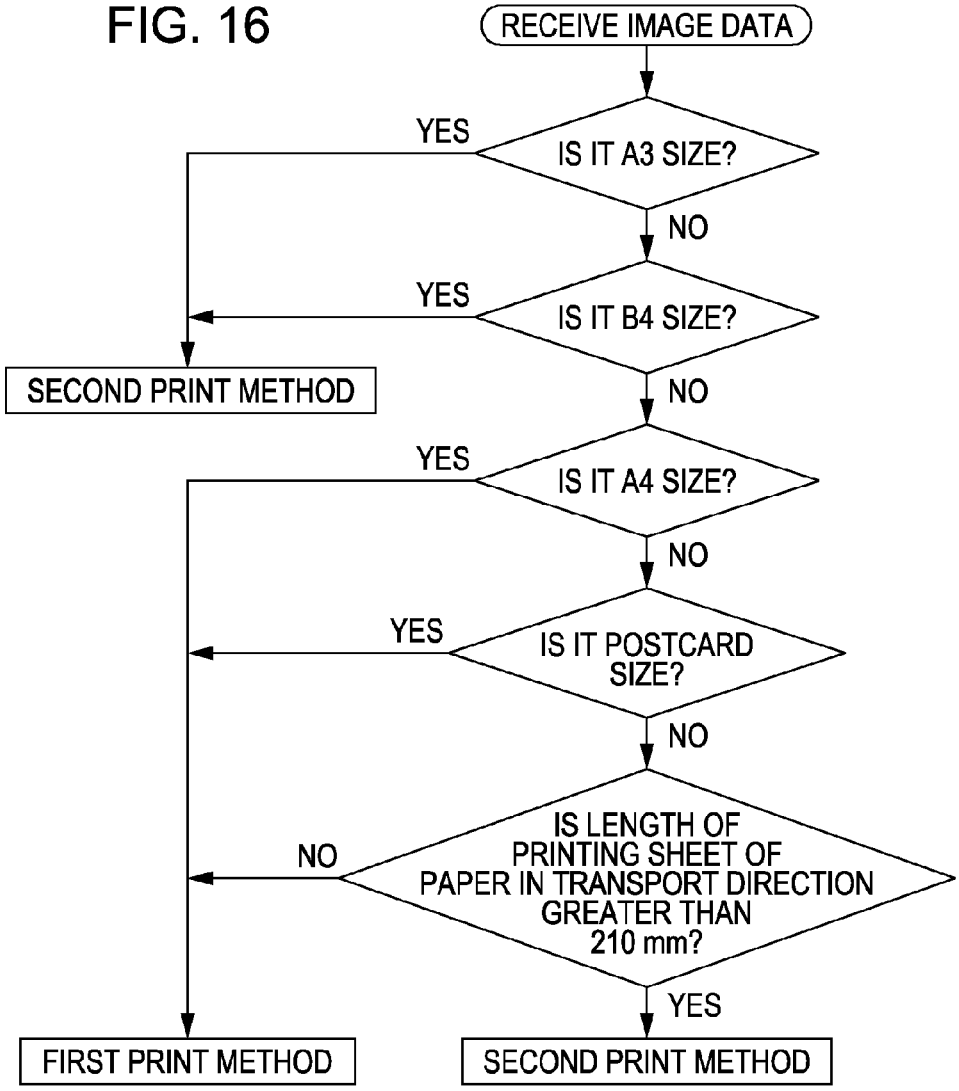
FIG. 16 is one example of a flowchart in which the printer driver determines a print method on the basis of the type of a printing sheet of paper.

FIG. 16 is one example of a flowchart in which the printer driver determines a print method on the basis of "a type of a printing sheet of paper". For example, where types of a printing sheet of paper that are printable by the printer 1 are A3 size, B4 size, A4 size, and postcard size, the printer driver determines that printing is performed in the second print method when A3 size or B4 size, larger than A4 size, is used for printing, and determines that printing is performed in the first print method when A4 size or postcard size that is smaller than A4 size is used for printing. Further, when printing is performed on an irregular printing sheet of paper, which is defined by a user, the printer driver determines a print method on the basis of the length of a printing sheet of paper in the transport direction. Note that the maximum paper size that is printable by the printer 1 is A3 size; the flowchart of FIG. 15 and the flowchart of FIG. 16 do not apply to a case where a printing sheet of paper is larger than A3 size.

Moreover, the printer driver may be instructed from application software so as to print a plurality of images as a single job. In addition, at this time, the size of a printing sheet of paper may be different depending on images. For example, a single job contains an image to be printed on an A4 size sheet of paper and an image to be printed on an A3 size sheet of paper. In this case, even when that is the same job, the printer driver detects whether the size of a printing sheet of paper in units of image and determines a print method.

Note that the print method is determined using the short side (210 mm) of the A4 size sheet of paper as a reference, as described above; however, this does not apply to the case where the head unit interval of the printer 1 is the head unit interval X9 of the second application example. Because the head unit interval of the second application example is greater than the head unit interval of the first application example, even when a sheet of paper has a length that is greater than 210 mm in the transport direction, there is a case where the maximum number of nozzle columns that face the sheet of paper at the same time does not exceed sixteen columns.

Then, when the head unit interval is set greater than the head unit interval X7 of the first application example, a print method is determined using the interval X10 between the most upstream side nozzle columns UU of the upstream side head unit and the most upstream side nozzle columns DU of the downstream side head unit as a reference (FIG. 11B). When the length of a printing sheet of paper in the transport direction is equal to or more than the interval X10, because the maximum number of nozzle columns that face the sheet of paper at the same time exceeds sixteen columns, so that printing is performed in the second print method. Then, when the length of a printing sheet of paper in the transport direction is smaller than the interval X10, because the maximum number of nozzle columns that face the sheet of paper at the same time is sixteen columns, printing is performed in the first print method.

Second Embodiment: Determination of Print Method on the Basis of Image Data

In the second embodiment, the printer driver determines a print method on the basis of "image data". For description, the head unit interval of the printer 1 is the head unit interval X7 of the first application example.

First Determination Example: Printing of Small Image

If printing is performed on an A3 size sheet of paper using the head unit interval X7 that is set using the short side of the A4 size sheet of paper as a reference, the A3 size sheet of paper faces all the nozzle columns (32 columns) of both the upstream side head unit 20A and the downstream side head unit 20B (FIG. 13). When ink is discharged at the same time from all the 32 nozzle columns that face the A3 size sheet of paper, the maximum power consumption exceeds the limit power consumption. However, when the number of nozzle columns that discharge ink does not exceed sixteen columns, the maximum power consumption does not exceed the limit power consumption.

Figure 17A:
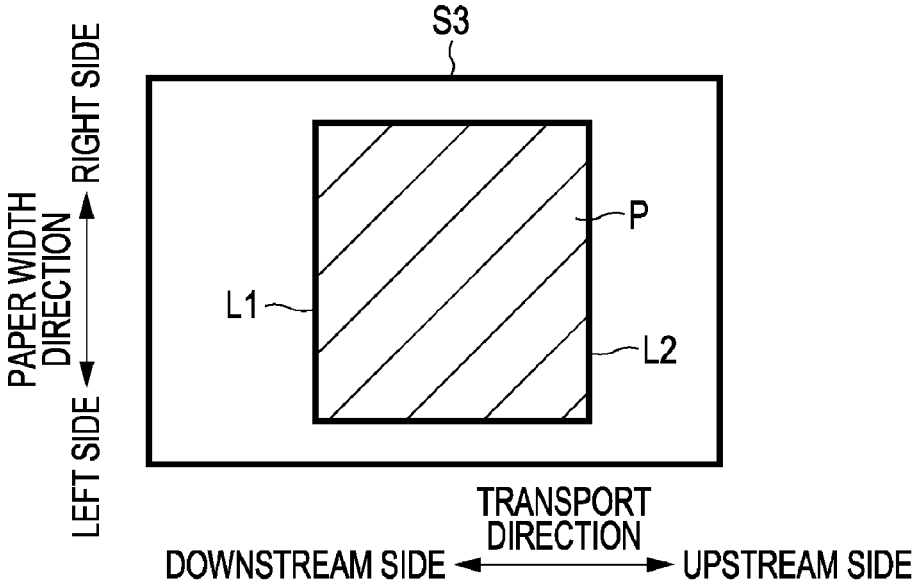
FIG. 17A is a view that shows a printing area in which an image is printed on an A3 size sheet of paper.

FIG. 17A is a view that shows a printing area P in which an image is printed on an A3 size sheet of paper S3. FIG. 17B to FIG. 17E are views that show a state where the image is printed within the printing area P on the A3 size sheet of paper. The printing area P is a collection of a plurality of pixels on which dots are formed, and ink is discharged from nozzles when the printing area P faces the nozzles.

Further, the printing area P is indicated by a rectangular oblique lines in the drawing. A most downstream side pixel column among pixel columns and a most upstream side pixel column, which are arranged along the paper width direction in the printing area P, are respectively denoted as a pixel column L1 and a pixel column L2. As shown in FIG. 17C, the size of the printing area P in the transport direction (the length from the pixel column L1 to the pixel column L2) is smaller than the interval X6 between the most upstream side nozzle columns UU of the upstream side head unit and the most upstream side nozzle columns DU of the downstream side head unit. Then, the image within the printing area P will be printed in color with a resolution of 720 dpi in the paper width direction.

Figure 17B:
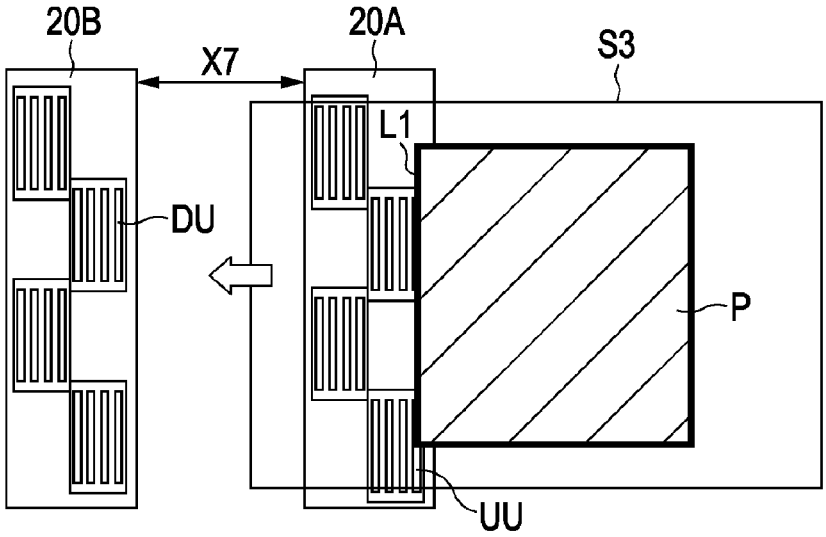
FIG. 17B is a view that shows a state where the image is printed within the printing area on the A3 size sheet of paper.
Figure 17C:
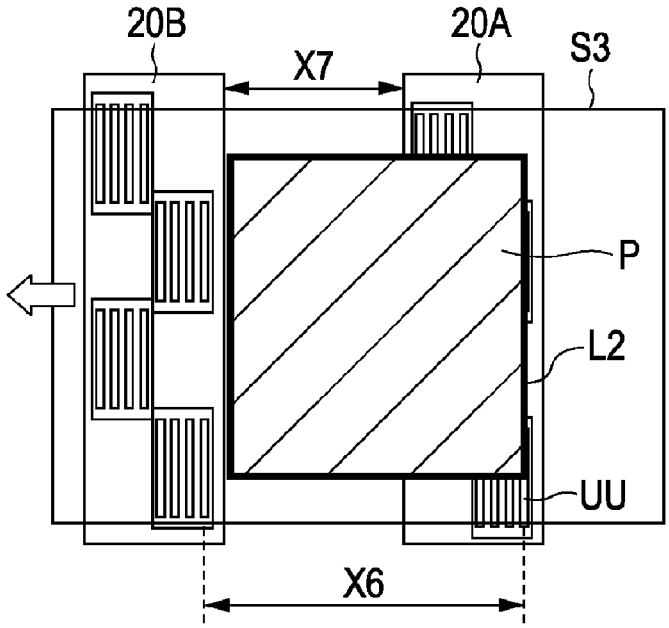
FIG. 17C is a view that shows a state where the image is printed within the printing area on the A3 size sheet of paper.

First, as shown in FIG. 17B, an A3 size sheet of paper is fed so that the pixel column L1 on the A3 size sheet of paper faces the most upstream side nozzle columns UU of the upstream side head unit. In the initial stage of printing, ink is discharged from only the 16 nozzle columns of the upstream side head unit toward the printing area P.

Then, when the pixel column L2 faces the most upstream side nozzle columns UU of the upstream side head unit, the printing area P does not face the nozzle columns of the downstream side head unit 20B (FIG. 17C). In addition, the front end side of the A3 size sheet of paper S3 faces the nozzle columns of the downstream side head unit 20B; however, the front end side of the A3 size sheet of paper S3 is a blank space, so that no ink is discharged from the nozzles of the downstream side head unit 20B. Therefore, the A3 size sheet of paper faces the 32 nozzle columns; however, the nozzle columns that discharge ink are sixteen columns.

Figure 17D:
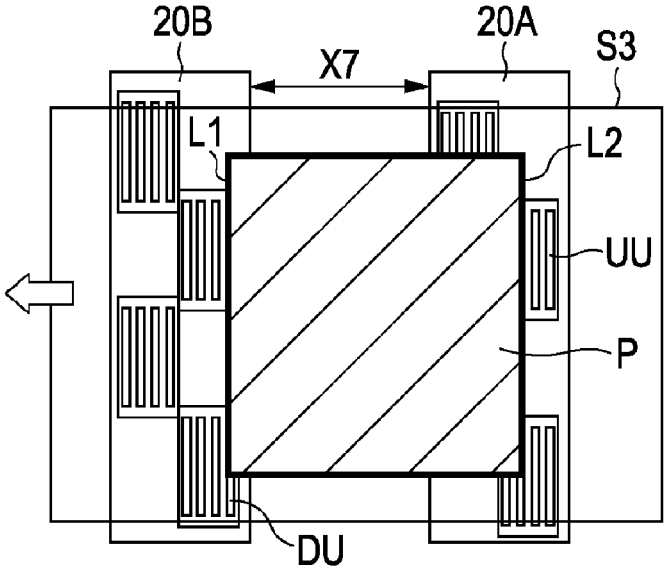
FIG. 17D is a view that shows a state where the image is printed within the printing area on the A3 size sheet of paper.
Figure 17E:
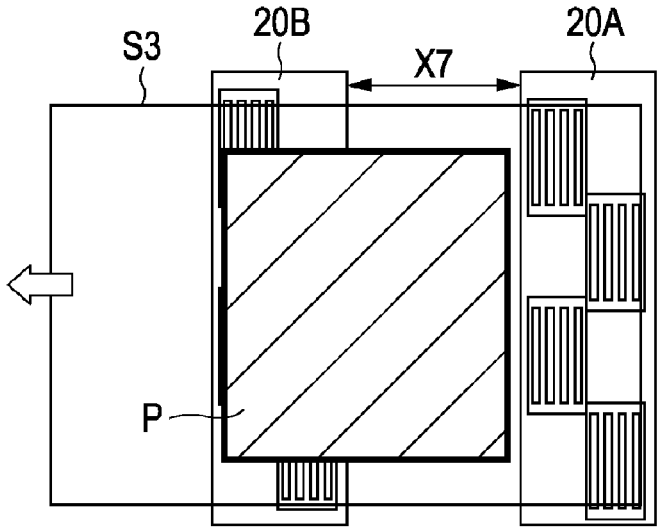
FIG. 17E is a view that shows a state where the image is printed within the printing area on the A3 size sheet of paper.

After that, when the pixel column L1 faces the most upstream side nozzle columns DU of the downstream side head unit, the pixel column L2 is passed below the most upstream side nozzle columns UU of the upstream side head unit (FIG. 17D). Therefore, the nozzle columns that discharge ink do not exceed sixteen columns. Consequently, ink is discharged from only the 16 nozzle columns of the downstream side head unit to the printing area P (FIG. 17E).

That is, when an image is printed within the printing area P on the A3 size sheet of paper, the A3 size sheet of paper faces all the nozzle columns (32 columns) of both the upstream side head unit 20A and the downstream side head unit 20B in midway of printing. However, the number of nozzle columns that discharge ink to the printing area P at the same time does not exceed sixteen columns. In other words, even when the number of nozzle columns the face a printing sheet of paper at the same time exceeds sixteen columns, there is a case where the number of nozzle columns that discharge ink at the same time does not exceed sixteen columns depending on the size of a printing image. In this case, even when printing is performed in the first print method in which the timing at which ink is discharged from the nozzles of the upstream side head unit 20A is the same as the timing at which ink is discharged from the nozzles of the downstream side head unit 20B, the maximum power consumption does not exceed the limit power consumption.

Then, in the first determination example, the printer driver determines a print method not on the basis of "the number of nozzle columns that face a printing sheet of paper at the same time" but on the basis of "the number of nozzle columns from which ink is discharged at the same time". That is, the printer driver determines on the basis of the number of nozzle columns that face pixels at which dots are formed on a printing sheet of paper (for example, printing area P).

Figure 18:
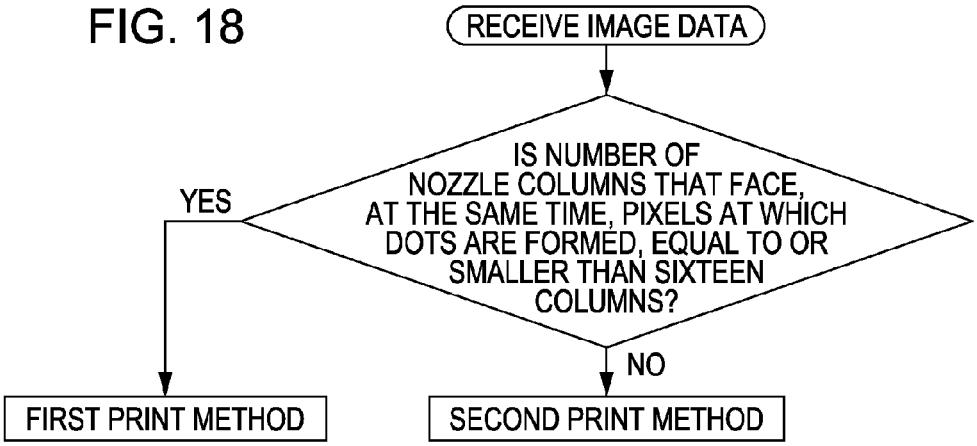
FIG. 18 is a flowchart that is executed when the printer driver determines a print method in a first determination example of a second embodiment.

FIG. 18 is a flowchart that is executed when the printer driver determines a print method in the first determination example of the second embodiment. First, the printer driver receives image data from various application software. Then, the printer driver determines whether the number of nozzle columns that face pixels, at the same time, at which dots are formed on a sheet of paper is equal to or smaller than sixteen columns.

If the number of nozzle columns that face pixels, at the same time, at which dots are formed on the printing sheet of paper is equal to or smaller than sixteen columns (YES), the printer driver instructs the printer 1 to perform printing on a printing sheet of paper in the first print method. Moreover, if the number of nozzle columns that face pixels, at the same time, at which dots are formed on the printing sheet of paper is greater than sixteen columns (NO) the printer driver instructs the printer 1 to perform printing on a printing sheet of paper in the second print method.

Thus, in the first determination example, the printer driver detects "the number of nozzle columns that face pixels, at the same time, at which dots are formed on a printing sheet of paper" from "image data", and a print method is then determined. That is, "the nozzle columns used" are nozzle columns that face, at the same time, an area on the printing sheet of paper, to which ink is discharged. By so doing, the number of nozzle columns that discharge ink at the same time does not exceed sixteen columns, and the maximum power consumption during printing also does not exceed the limit power consumption.

Figure 17F:
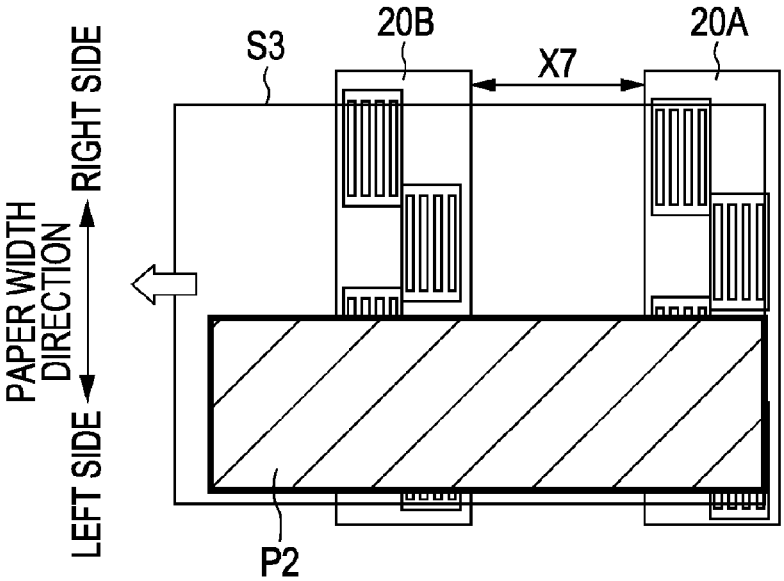
FIG. 17F is one example of a relatively small image.

Then, the case where the number of nozzle columns that face pixels, at the same time, at which dots are formed on a printing sheet of paper is equal to or smaller than sixteen columns, is a case where a relatively small image is printed. For example, as shown in FIG. 17A, an image, or the like, of which the length of a printing area in the transport direction is equal to or smaller than the length of the short side of the A4 size sheet of paper. That is, the transport speed is determined on the basis of the length of an image in the transport direction. Note that the determined transport speed is never changed while the printing sheet of paper is being transported. FIG. 17F is one example of a relatively small image P2. The length of the image P2 in the transport direction is greater than the length of the short side of the A4 size sheet of paper, but the image P2 is located only on the left side half of the A3 size sheet of paper. In this case, ink is discharged only from both the left side half nozzle columns of the upstream side head unit 20A and the left side half nozzle columns of the downstream side head unit 20B, and the number of nozzle columns that discharge ink does not exceed sixteen columns.

Note that when the head unit interval is determined using the A4 size sheet of paper as a reference, the number of nozzle columns that face a printing sheet of paper having a size equal to or smaller than A4 size at the same time does not exceed sixteen columns. Therefore, the first determination example may only be applied to a size larger than A4 size.

Furthermore, in contrast with the first determination example, a print method is determined on the basis of "the size of a printing sheet of paper" in the first embodiment. That is, in the first embodiment, even when the number of nozzle columns that discharge ink at the same time does not exceed sixteen columns, when the size of a printing sheet of paper is A3 size, printing is performed in the second print method. Because the transport speed of the first print method is twice the transport speed of the second print method, when a small image is printed, it is possible to shorten the printing time in the first determination example more than that of the first embodiment. However, because the first determination example detects the number of nozzle columns that discharge ink in each pieces of image data, a determination method of a print method by the printer driver is more complicated than that of the first embodiment.

Second Determination Example: Monochrome Printing

The heads 21 of the printer 1 of the present embodiment includes nozzle columns of four colors YMCK, so that both color printing and monochrome printing may be performed. Then, when in monochrome printing, only black ink is used.

When printing is performed on an A3 size sheet of paper with a resolution of 720 dpi in the paper width direction using the head unit interval X7 of the first application example, the sheet of paper faces all the nozzle columns (32 columns) of both the upstream side head unit 20A and the downstream side head unit 20B (FIG. 13). If this is color printing, there is a possibility that ink is discharged from all the 32 nozzle columns that face the A3 size sheet of paper. As a result, the maximum power consumption exceeds the limit power consumption. However, if it is monochrome printing, ink is discharged only from black nozzles K of eight columns (=32/4) among the 32 columns that face the A3 size sheet of paper. That is, the maximum number of nozzle columns from which ink is discharged at the same time is eight columns. Even when ink is discharged from the nozzles of both the upstream side head unit 20A and the downstream side head unit 20B at the same time, the maximum power consumption does not exceed the limit power consumption.

Then, in the second determination example, the printer driver detects, on the basis of data of a print mode in image data, "whether it is monochrome printing or color printing" and then determines a print method.

Figure 19:
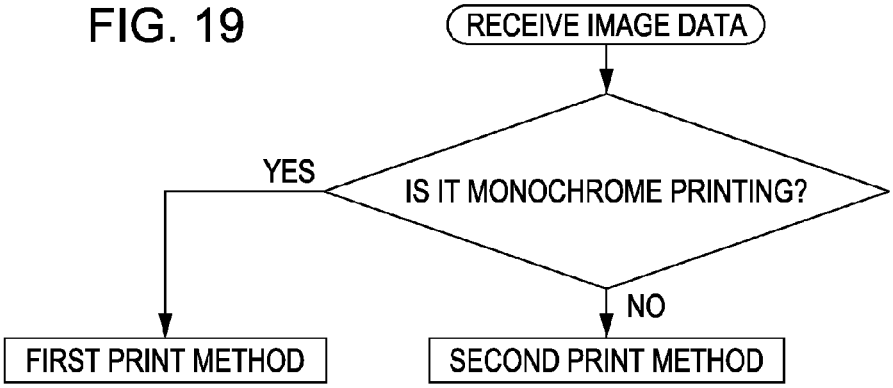
FIG. 19 is a flowchart that is executed when the printer driver determines a print method in a second determination example.

FIG. 19 is a flowchart that is executed when the printer driver determines a print method in the second determination example. First, the printer driver receives image data from various application software. Then, the printer driver detects whether an image is printed with monochrome or an image is printed with color.

If the image is printed with monochrome (YES), the printer driver instructs the printer 1 to perform printing on a printing sheet of paper in the first print method. On the other hand, if the image is printed with color (NO), the printer driver instructs the printer 1 to perform printing on a printing sheet of paper in the second print method. That is, the transport speed in color printing (when first liquid and second liquid are discharged) is lower than the transport speed in monochrome printing (the first liquid is discharged but the second liquid is not discharged). Note that the transport speed is never changed while the printing sheet of paper is being transported.

In the second determination example as described above, the printer driver detects, on the basis of "image data" whether "an image is printed with monochrome or an image is printed with color" and then determines a print method. By so doing, the maximum power consumption during printing does not exceed the limit power consumption.

Third Determination Example: Low-Resolution Printing

The printer 1 of the present embodiment is able to perform printing with a high resolution (720 dpi in the paper width direction) using both the upstream side head unit 20A and the downstream side head unit 20B and is able to perform printing with a low resolution using any one of the upstream side head unit 20A and the downstream side head unit 20B.

When a color image is printed on an A3 size sheet of paper using the head unit interval X7 of the first application example, the sheet of paper faces all the nozzle columns (32 columns) of both the upstream side head unit 20A and the downstream side head unit 20B (FIG. 13). If printing is performed with 720 dpi in the paper width direction at this time, there is a possibility that ink is discharged from all the nozzle columns that face the A3 size sheet of paper. As a result, the maximum power consumption exceeds the limit power consumption. However, if printing is performed with 360 dpi in the paper width direction, ink is discharged only from any one of the upstream side head unit 20A and the downstream side head unit 20B. At this time, the maximum number of nozzle columns from which ink are discharged is sixteen columns, and the maximum power consumption does not exceed the limit power consumption, so that it is not necessary to alternately discharge ink from the upstream side head unit and the downstream side head unit. That is, when in a low-resolution printing, by performing printing in the first print method, it is possible to shorten the printing time.

Then, in the third determination example, the printer driver determines a print method on the basis of "resolution in the paper width direction" from data of a print mode in image data.

Figure 20:
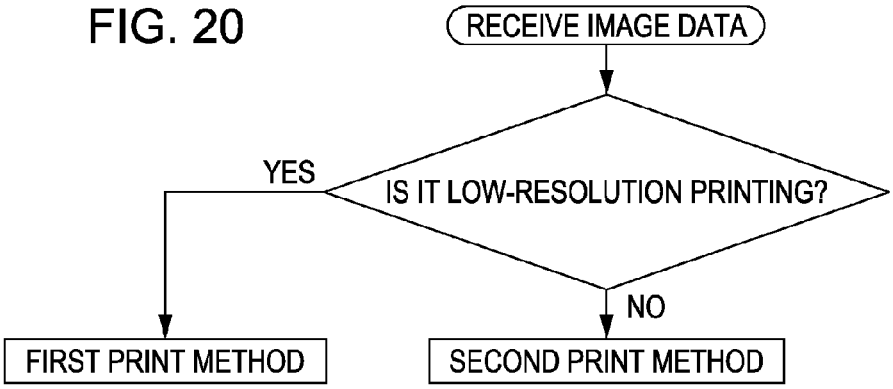
FIG. 20 is a flowchart that is executed when the printer driver determines a print method in a third determination example.

FIG. 20 is a flowchart that is executed when the printer driver determines a print method in the third determination example. First, the printer driver receives image data from various application software. Then, the printer driver detects resolution in the paper width direction.

If printing is performed with a resolution of 360 dpi in the paper width direction (low-resolution printing) (YES), the printer driver instructs the printer 1 to perform printing on a printing sheet of paper in the first print method. On the other hand, if printing is performed with a resolution of 720 dpi in the paper width direction (high-resolution printing) (NO), the printer driver instructs the printer 1 to perform printing on a printing sheet of paper in the second print method. That is, the transport speed when printing is performed with a high resolution using both the upstream side head unit 20A and the downstream side head unit 20B is lower than the transport speed when printing is performed with a low resolution using any one of the upstream side head unit 20A and the downstream side head unit 20B. Note that the transport speed is never changed while the printing sheet of paper is being transported.

In the third determination example as described above, the printer driver detects, on the basis of "image data" whether "an image is printed with a low resolution or an image is printed with a high resolution" and then determines a print method. By so doing, the maximum power consumption during printing does not exceed the limit power consumption, and it is possible to shorten the printing time.

Third Embodiment: Change in Print Method in Midway of Printing

Figure 21A:
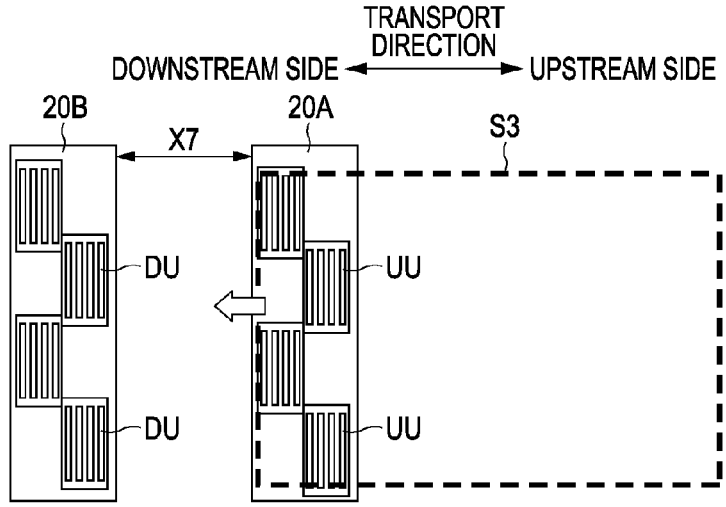
FIG. 21A to FIG. 21C are views that show a state where an A3 size sheet of paper is transported.
Figure 21B:
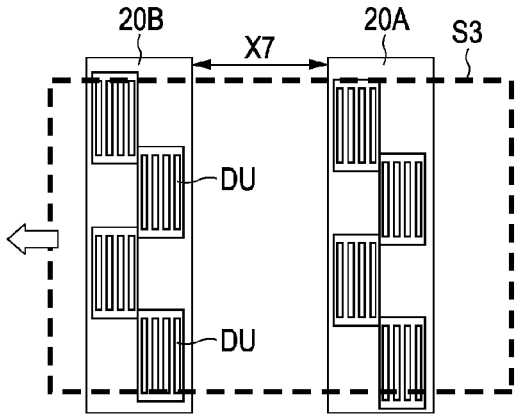
Figure 21C:
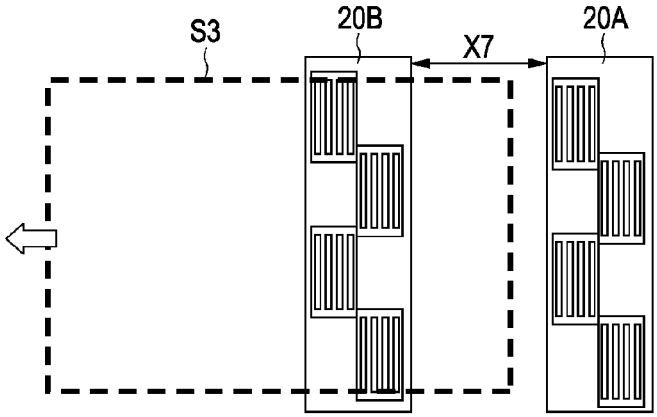
Figure 22A:
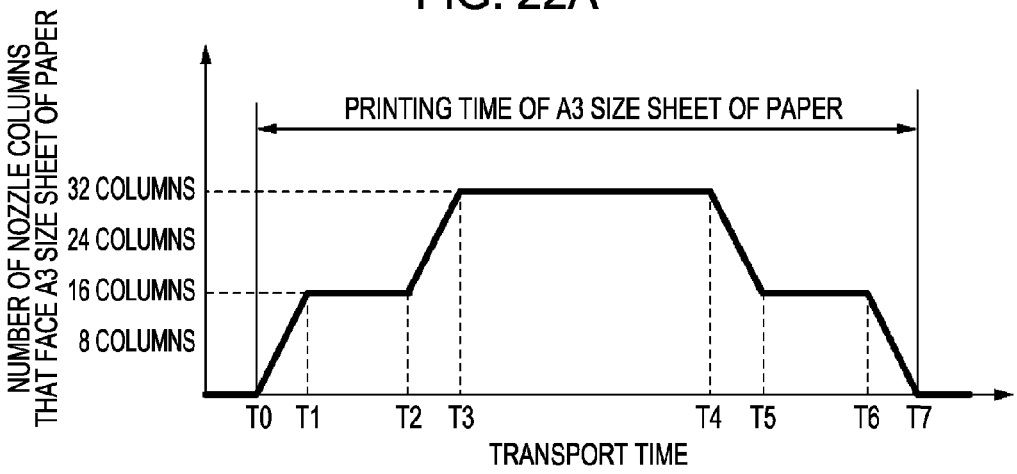
FIG. 22A is a view that shows a relationship between the number of nozzle columns that face an A3 size sheet of paper and transport time.

The number of nozzle columns that face a printing sheet of paper changes with time while the printing sheet of paper is being transported. In the third embodiment, a print method is changed "in midway of printing of one printing sheet of paper". For description, the head unit interval of the printer 1 is the head unit interval X7 of the first application example, and a color image is printed with a resolution of 720 dpi in the paper width direction on an A3 size sheet of paper. FIG. 21A to FIG. 21C are views that show a state where an A3 size sheet of paper S3 is transported. FIG. 22A is a view that shows a relationship between the number of nozzle columns that face the A3 size sheet of paper and transport time.

The front end of the A3 size sheet of paper initially faces two most upstream side nozzle columns UU of the upstream side head unit. Then, as the A3 size sheet of paper is transported, the number of nozzle columns that face the A3 size sheet of paper increases and, at time T1, the A3 size sheet of paper faces the 16 nozzle columns of the upstream side head unit (FIG. 21A).

After that, until time T2 at which the front end of the A3 size sheet of paper faces the most upstream side nozzle columns DU of the downstream side head unit, the number of nozzle columns that face the A3 size sheet of paper does not increase and sixteen columns are maintained to face the A3 size sheet of paper. Then, from time T2, the number of nozzle columns of the downstream side head unit, which face the front end side of the A3 size sheet of paper, increases.

Thereafter, at time T3, the A3 size sheet of paper faces all the nozzle columns (32 columns) of both the upstream side head unit and the downstream side head unit (FIG. 21B). The number of nozzle columns that face the A3 size sheet of paper does not increase more than 32 columns. From time T4 at which the rear end of the A3 size sheet of paper is passed below the most upstream side nozzle columns UU of the upstream side head unit, the number of nozzle columns that face the A3 size sheet of paper gradually reduces.

From print start time T0 to time T2, the A3 size sheet of paper faces only the upstream side head unit 20A. Therefore, even when ink is discharged from all the nozzles of the 16 nozzle columns that face the A3 size sheet of paper at this time, the maximum power consumption does not exceed the limit power consumption.

However, from time T2, the number of nozzle columns that face the A3 size sheet of paper exceeds sixteen columns, if ink is discharged from all the nozzle columns that face the A3 size sheet of paper at the same time, the maximum power consumption exceeds the limit power consumption.

However, from time T5, the A3 size sheet of paper faces only the downstream side head unit 20B. Therefore, the number of nozzle columns that face the A3 size sheet of paper is again equal to or smaller than sixteen columns, so that the maximum power consumption does not exceed the limit power consumption.

Then, in the third embodiment, when the A3 size sheet of paper faces only one of the upstream side head unit and the downstream side head unit (from T0 to T2, and from T5 to T7), it is not necessary to alternately discharge ink from the upstream side head unit and from the downstream side head unit, so that printing is performed in the first print method. Then, when the A3 size sheet of paper faces both the upstream side head unit and the downstream side head unit (from T2 to T5), printing is performed in the second print method in which ink is alternately discharged from the upstream side head unit and from the downstream side head unit. That is, the transport speed changes while a printing sheet of paper is being transported. By so doing, the maximum power consumption does not exceed the limit power consumption. Note that, in the first embodiment and in the second embodiment, the transport speed does not change while a printing sheet of paper is being transported. Then, the transport speed is determined on the basis of the maximum number of nozzle columns among "the number of nozzle columns used" that changes while a printing sheet of paper is being transported.

Figure 22B:
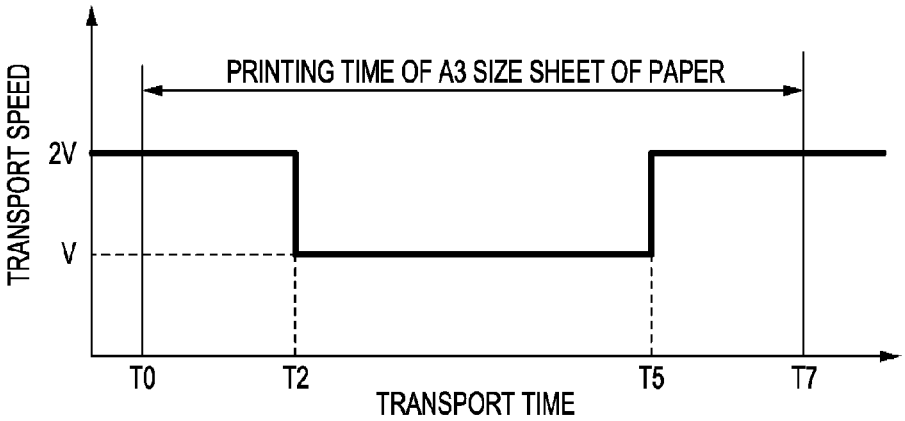
FIG. 22B is a view that shows changes in transport speed while printing is being performed on an A3 size sheet of paper.

FIG. 22B is a view that shows changes in transport speed while printing is being performed on an A3 size sheet of paper. At time T2 at which the number of nozzle columns that face the A3 size sheet of paper exceeds sixteen columns, the print method is switched from the first print method to the second print method and, thereby, the transport speed reduces from 2V to V. At time T5 at which the number of nozzle columns that face the A3 size sheet of paper is again equal to or smaller than sixteen columns, the print method is switched from the second print method to the first print method and, thereby, the transport speed increases from V to 2V. In addition, as in the case of the transport speed, as the print method is switched, the driving signal generated in each driving signal generating circuit also changes.

In regard to timing at which the print method is switched, that is, timing (T2) at which the A3 size sheet of paper initiates to face the downstream side head unit, or timing (T5) at which the A3 size sheet of paper is passed below the upstream side head unit, a position of the A3 size sheet of paper is managed using a sensor, or the like. For example, time T8 from when the A3 size sheet of paper is detected by the paper detecting sensor 41 shown in FIG. 2A to when the front end of the A3 size sheet of paper faces the downstream side head unit may be obtained in advance. Then, the print method may be switched after time T8 has elapsed from when the A3 size sheet of paper is detected by the paper detecting sensor 41.

In the third embodiment as described above, by switching the print method "while printing is being performed on one printing sheet of paper", the number of nozzle columns from which ink is discharged at the same time does not exceed sixteen columns, and the maximum power consumption during printing does not exceed the limit power consumption. Furthermore, because, in the initial state and last stage of printing, printing is performed in the first print method in which the transport speed is high, it is possible to shorten the printing time as compared with the first embodiment in which the A3 size sheet of paper is printed only in the second print method.

Note that, at time T2 in FIG. 22B, the transport speed is instantaneously reduced to half, but it is not limited to it. Actually, it is difficult to instantaneously change the transport speed to a target speed, and it takes some time to converge on the target speed. Therefore, immediately after the transport speed is changed, there is a possibility that a printing sheet of paper is not transported by a predetermined amount and, thereby, dots are not formed at appropriate positions. As a result, portions at which dots are not appropriately formed appear as stripes on an image, thus deteriorating image quality.

Then, by gradually approximating the transport speed to half the transport speed, it is possible to reduce deterioration of image quality. This is because a transport error is smaller when the transport speed is gradually reduced to half than when the transport speed is instantaneously reduced to half, and, thereby, deviation of dots from appropriate positions also becomes minute. However, in this case, until the transport speed is reduced to half the speed, it is not allowed to switch from the first driving signal DRV1 to the second driving signal DRV2 (FIG. 14), so that it is necessary to, for example, delay the driving signal as the transport speed is gradually reduced.

Alternative Embodiments

In the above described embodiments, it is mainly described as to a printing system that includes an ink jet printer; however, a method of reducing maximum power consumption, or the like, is also included in the disclosure. In addition, the above described embodiments are intended to easily understand the aspects of the invention and are not used to limit the scope of the invention. The invention may be modified or improved without departing from the scope of the invention, and, of course, the invention also encompasses equivalents thereof. For example, the following alternative embodiments may also be included in the scope of the invention.

Head Unit Interval

In the above described embodiments, the head unit interval is set so that the short side of the A4 size sheet of paper is used as a reference, and, when printing is performed on the A3 size sheet of paper, the transport speed is reduced without changing the head unit interval; however, it is not limited to it. For example, the head unit interval may be variable. That is, the upstream side head unit and the downstream side head unit may be moved relatively in the transport direction. By so doing, in conformity with the size of a printing sheet of paper, it is possible to change the head unit interval so that the maximum power consumption is suppressed to a certain value. Note that the head unit interval may be moved by a printer or by a user. As a result, types of printable paper size are increased. Then, it is only necessary to reduce the transport speed only when the number of heads that face a printing sheet of paper at the same time is large and the maximum power consumption becomes large even with a maximum head unit interval.

First Embodiment and Second Embodiment

Figure 23:
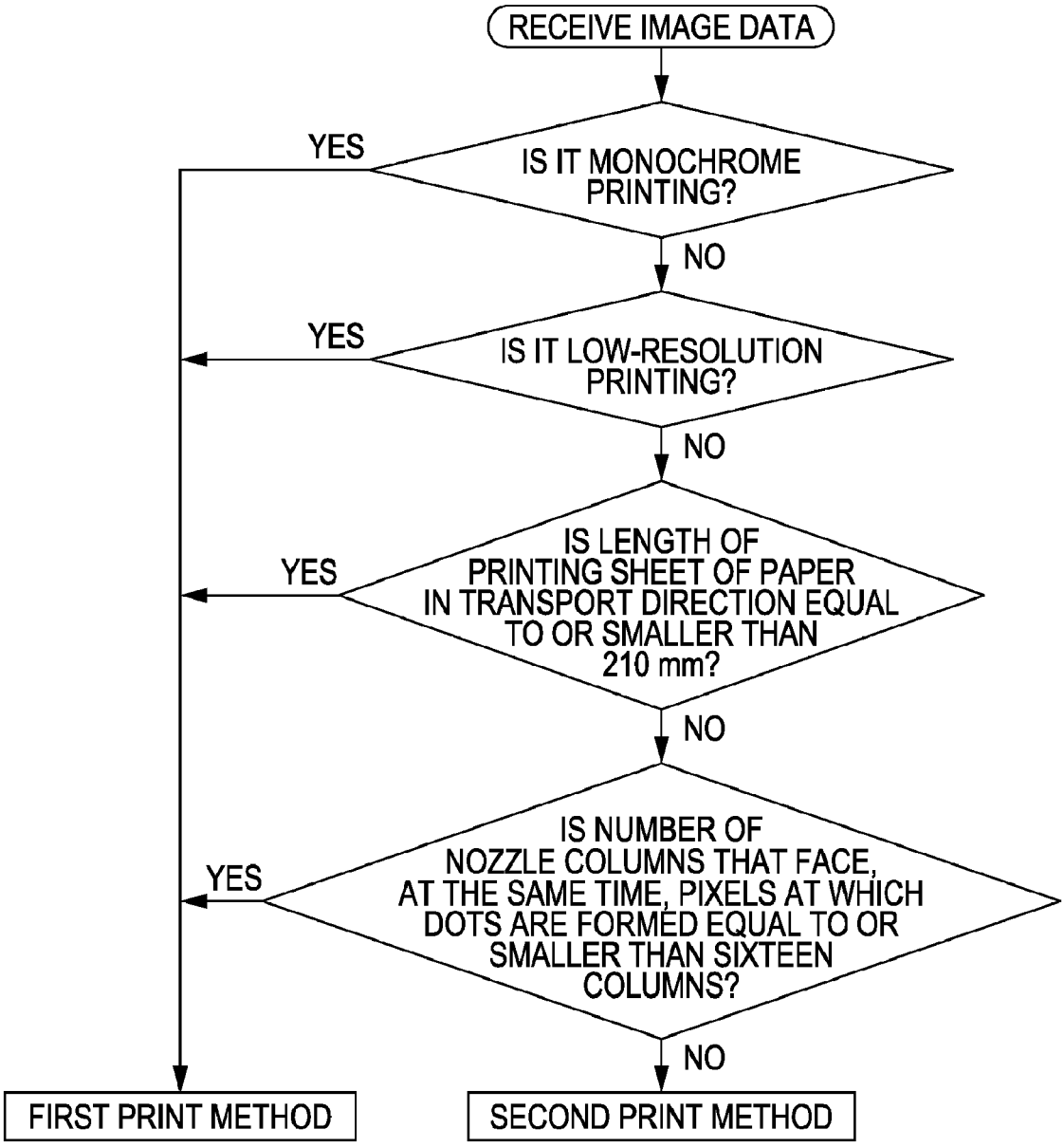
FIG. 23 is one example of a flowchart that is executed in the case where a plurality of reference items are combined.

In the above described second embodiment and the third embodiment, the printer driver determines a print method using one item as a reference; however, it is not limited to it. For example, a plurality of reference items may be combined for determining a print method. FIG. 23 is one example of a flowchart that is executed in the case where a plurality of reference items are combined. At first, the printer driver determines (second determination example, third determination example) whether printing can be performed in the first print method on the basis of data of a print mode (color of printing, resolution). Then, the printer driver determines whether printing can be performed in the first print method on the basis of paper size (first embodiment). Finally, the printer driver determines whether printing can be performed in the first print method on the basis of the size of an image to be printed (first determination example). Because a method of determining a print method on the basis of the size of an image is complicated, when it is confirmed that printing can be performed in the first print method using items other than the item using the size of an image, it is possible to determine a print method more quickly than to confirm the sizes of all images.

Printer Driver

In the above described embodiments, a print method is determined at the printer driver side in the computer 30; however, it is not limited to it. For example, the controller 50 of the printer 1 may be configured to determine a print method. In this case, only the printer is a liquid discharging apparatus.

Ink Jet Line Head Printer

In the above described embodiments, the ink jet line head printer is used as a liquid discharging apparatus, for example; however, it is not limited to it. The aspects of the invention may be applied to various industrial apparatuses, other than the printer (printing apparatus). For example, the invention may be applied to any liquid discharging apparatuses, such as a color filter manufacturing apparatus, a display manufacturing equipment for an organic EL display, or the like, a semiconductor manufacturing equipment, a DNA chip manufacturing equipment, a circuit board manufacturing equipment, and a printing equipment for printing a pattern on a cloth, or the like, other than the printer (printing apparatus). In addition, the printer of the above described embodiments applies a voltage to a driving element (piezoelectric element) to expand/contract an ink chamber, thus discharging liquid. However, it is not limited to it. For example, the printer may be configured to discharge liquid using bubbles generated in a nozzle by means of electric heating element.

High-Resolution Printing

In the above described embodiments, high-resolution printing is enabled in such a manner that nozzle columns of the downstream side head unit 20B is offset at a half nozzle pitch in the paper width direction relative to the nozzle columns of the upstream side head unit 20A; however, it is not limited to it. For example, the nozzle columns of the upstream side head unit 20A and the downstream side head unit 20B need not be offset in the paper width direction. By alternately forming dots (overlapping print) from the nozzles #i of the upstream side head unit 20A and the nozzles #i of the downstream side head unit 20B, which are arranged in the transport direction, for forming raster lines along the transport direction, it cannot perform high-resolution printing but it is possible to reduce deterioration of image quality when nozzle missing is present, or the like.

Number of Head Units

In the above described embodiments, a method of setting an interval between two head units, that is, the upstream side head unit 20A and the downstream side head unit 20B, is described, for example; however, it is not limited to it. For example, even when three head units are used, the aspects of the invention may be applied to setting an interval between the head units.

What is claimed is:

1. A liquid discharging apparatus comprising:

an upstream side nozzle group;

a downstream side nozzle group that is located on a downstream side in a transport direction as compared with the upstream side nozzle group;

a transport mechanism that transports a medium in the transport direction to the upstream side nozzle group and to the downstream side nozzle group, and a controller capable of controlling the transport mechanism such that the transport mechanism varies the speed at which the medium is transported in the transport direction, wherein the upstream side nozzle group and the downstream side nozzle group each are formed of a plurality of nozzle columns which eject liquid of a plurality of colors that are arranged in the transport direction, wherein each of the nozzle columns is formed so that a plurality of nozzles that discharge liquid are arranged in a direction that intersects with the transport direction, and wherein the transport speed varies in accordance with the number of nozzle columns used such that only a predetermined number of nozzle columns of the plurality of colors are disposed above the medium at the same time.

2. The liquid discharging apparatus according to claim 1, wherein the transport speed is controlled by the controller such that when the number of nozzle columns used is more than a predetermined number is lower than the transport speed when the number of nozzle columns used is equal to or smaller than the predetermined number.

3. The liquid discharging apparatus according to claim 2, wherein the predetermined number is the number of nozzle columns that the upstream side nozzle group or the downstream side nozzle group has.

4. The liquid discharging apparatus according to claim 2, wherein, when the number of nozzle columns used is more than the predetermined number, liquid is alternately discharged from the nozzles of the upstream side nozzle group and from the nozzles of the downstream side nozzle group.

5. The liquid discharging apparatus according to claim 1, wherein the nozzle columns used are nozzle columns that face the medium at the same time.

6. The liquid discharging apparatus according to claim 5, wherein the transport speed is determined in accordance with the length of the medium in the transport direction.

7. The liquid discharging apparatus according to claim 1, wherein the nozzle columns used are nozzle columns that face, at the same time, an area on the medium, to which liquid is discharged.

8. The liquid discharging apparatus according to claim 7, wherein the transport speed is determined on the basis of the length of the area in the transport direction.

9. The liquid discharging apparatus according to claim 1, wherein the transport speed is controlled by the controller such that when liquid is discharged using both the upstream side nozzle group and the downstream side nozzle group is lower than the transport speed when liquid is discharged using one of the upstream side nozzle group and the downstream side nozzle group.

10. The liquid discharging apparatus according to claim 9, wherein, when the nozzle columns of the downstream nozzle group are offset from the nozzle columns of the upstream side nozzle group in the direction that intersects with the transport direction, the transport speed when liquid is discharged in a high resolution using both the upstream side nozzle group and the downstream side nozzle group is lower than the transport speed when liquid is discharge in a low resolution using one of the upstream side nozzle group and the downstream side nozzle group.

11. The liquid discharging apparatus according to claim 1, wherein, when the upstream side nozzle group and the downstream side nozzle group each have nozzle columns that discharge first liquid and nozzle columns that discharge second liquid, the transport speed when the first liquid and the second liquid are discharged onto the medium is lower than the transport speed when the first liquid is discharged onto the medium but the second liquid is not discharged onto the medium.

12. The liquid discharging apparatus according to claim 1, wherein the transport speed is controlled by the controller such that the transport speed changes when the medium is being transported.

13. The liquid discharging apparatus according to claim 1, wherein the transport speed is is controlled by the controller on the basis of the maximum number of nozzle columns used.

14. The liquid discharging apparatus according to claim 1, further comprising:

a mechanism that moves the upstream side nozzle group and the downstream side nozzle group relatively in the transport direction.

* * * * *